US011842746B2

(12) United States Patent
Yasura

(10) Patent No.: US 11,842,746 B2
(45) Date of Patent: Dec. 12, 2023

(54) DIGITAL AUDIO PROCESSING WITH EVEN AND ODD HARMONIC COMPONENT ADDITION

(71) Applicant: JVCKENWOOD Corporation, Yokohama (JP)

(72) Inventor: Sadahiro Yasura, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 4 days.

(21) Appl. No.: 17/574,625

(22) Filed: Jan. 13, 2022

(65) Prior Publication Data

US 2022/0139416 A1 May 5, 2022

Related U.S. Application Data

(63) Continuation of application No. PCT/JP2020/029491, filed on Jul. 31, 2020.

(30) Foreign Application Priority Data

Aug. 8, 2019 (JP) ..... 2019-146149

(51) Int. Cl.
*G10L 21/0332* (2013.01)
*G10H 7/12* (2006.01)
(Continued)

(52) U.S. Cl.
CPC ..... *G10L 21/0332* (2013.01); *G10L 19/02* (2013.01); *G10L 25/78* (2013.01); *G10L 2025/783* (2013.01)

(58) Field of Classification Search
CPC ..... G10L 21/00; G10L 21/007; G10L 21/10; G10L 21/0316; G10L 21/0332;
(Continued)

(56) References Cited

U.S. PATENT DOCUMENTS 4,646,612 A * 3/1987 Suzuki ..... G10H 7/12 84/625
4,700,603 A * 10/1987 Takauji ..... G10H 7/105 84/622
(Continued)

FOREIGN PATENT DOCUMENTS

JP 3401171 B2 2/2003
JP 3659489 B2 3/2005
(Continued)

*Primary Examiner* — Martin Lerner
(74) *Attorney, Agent, or Firm* — Nath, Goldberg & Meyer; Jerald L. Meyer

(57) ABSTRACT

An even-numbered harmonic adder adds a correction value to a first adjacent sample that is the next sample after a first local minimum sample, and subtracts a correction value from a second adjacent sample that is one sample before a local maximum sample. The even-numbered harmonic adder adds a correction value to a third adjacent sample that is the next sample after the local maximum sample, and subtracts a correction value from a fourth adjacent sample that is one sample before a second local minimum sample. An odd-numbered harmonic adder subtracts a correction value from the first local minimum sample and the second local minimum sample, and adds a correction value to the local maximum sample.

6 Claims, 17 Drawing Sheets

(51) Int. Cl.
*G10L 19/02* (2013.01)
*G10L 25/78* (2013.01)

(58) Field of Classification Search
CPC .. G10H 7/08; G10H 7/10; G10H 7/12; G10H 2220/116; G10H 2250/615
USPC ..... 700/94; 704/200.1, 201, 205, 206, 500, 704/501, 278; 84/622, 624, 625
See application file for complete search history.

(56) References Cited

U.S. PATENT DOCUMENTS

| | | | | |
|---|---|---|---|---|
| 4,991,485 | A * | 2/1991 | Takauji | G10H 7/105 84/625 |
| 6,449,519 | B1 * | 9/2002 | Kuwaoka | G11B 20/10 700/94 |
| 7,024,260 | B2 * | 4/2006 | Kuwaoka | G11B 20/10527 700/94 |
| 2003/0236584 | A1 * | 12/2003 | Kuwaoka | G10L 19/02 700/94 |
| 2008/0082189 | A1 * | 4/2008 | Kuwaoka | G10L 19/26 700/94 |
| 2010/0010649 | A1 * | 1/2010 | Ooue | G11B 20/10527 700/94 |
| 2016/0044429 | A1 * | 2/2016 | Moffat | G10L 25/51 381/56 |

FOREIGN PATENT DOCUMENTS

| | | | | |
|---|---|---|---|---|
| JP | 4985570 B2 | | 5/2012 | |
| WO | WO 2019/093165 | * | 10/2018 | G10L 21/0332 |

* cited by examiner

FIG. 3

| SAMPLE INTERVAL | COEFFICIENT SELECTING SIGNAL | COEFFICIENT |
|---|---|---|
| TWO SAMPLES | 00 | 1/2 |
| | 01 | 1/4 |
| | 10 | 1/8 |
| | 11 | 1/16 |
| THREE SAMPLES | 00 | 1/2 |
| | 01 | 1/4 |
| | 10 | 1/8 |
| | 11 | 1/16 |
| FOUR SAMPLES | 00 | 1/4 |
| | 01 | 1/8 |
| | 10 | 1/16 |
| | 11 | 1/32 |
| FIVE SAMPLES | 00 | 1/4 |
| | 01 | 1/8 |
| | 10 | 1/16 |
| | 11 | 1/32 |
| SIX SAMPLES | 00 | 1/8 |
| | 01 | 1/16 |
| | 10 | 1/32 |
| | 11 | 1/64 |
| SEVEN SAMPLES | 00 | 1/8 |
| | 01 | 1/16 |
| | 10 | 1/32 |
| | 11 | 1/64 |
| EIGHT SAMPLES | 00 | 1/16 |
| | 01 | 1/32 |
| | 10 | 1/64 |
| | 11 | 1/128 |

DIGITAL AUDIO PROCESSING WITH EVEN AND ODD HARMONIC COMPONENT ADDITION

CROSS REFERENCE TO RELATED APPLICATION

This application is a Continuation of PCT Application No. PCT/JP2020/029491, filed on Jul. 31, 2020, and claims the priority of Japanese Patent Application No. 2019-146149, filed on Aug. 8, 2019, the entire contents of both of which are incorporated herein by reference.

BACKGROUND

The present disclosure relates to a digital audio processing device, a digital audio processing method, and a digital audio processing program for processing a digital audio signal.

Japanese Patent No. 3401171 (Patent Literature 1) discloses a digital audio processing device for improving the quality of sound by processing a digital audio signal as follows. The digital audio processing device detects a sample interval between a local maximum sample having a local maximum of a waveform of a digital audio signal and a local minimum sample having a local minimum. The digital audio processing device adds a correction value to adjacent samples before and after the local maximum sample, the correction value being obtained by multiplying a difference value between the local maximum sample and an adjacent sample by a coefficient of less than 1. The digital audio processing device subtracts a correction value from adjacent samples before and after the local minimum sample, the correction value being obtained by multiplying a difference value between the local minimum sample and an adjacent sample by a coefficient of less than 1.

SUMMARY

According to the digital audio processing device disclosed in Patent Literature 1, only odd-numbered harmonics are added to a digital audio signal. In a digital audio processing device disclosed in Japanese Patent No. 3659489 (Patent Literature 2) also, only odd-numbered harmonics are added to a digital audio signal. Odd-numbered harmonics added to the fundamental basically improve the quality of sound, but may cause some people to feel irritated and uncomfortable. In general, people often feel comfortable with even-numbered harmonics added to the fundamental. Therefore, it is desirable to add both even-numbered harmonics and odd-numbered harmonics to a digital audio signal.

Japanese Patent No. 4985570 (Patent Literature 3) discloses a configuration of adding both even-numbered harmonics and odd-numbered harmonics to a digital audio signal. The digital audio processing device disclosed in Patent Literature 3 adds or subtracts a correction value to or from a sample of only either one of a waveform part in which a sample value increases from a local minimum sample to a local maximum sample and a waveform part in which a sample value decreases from a local maximum sample to a local minimum sample. By this configuration, both even-numbered harmonics and odd-numbered harmonics are added to a digital audio signal.

However, it is not preferable to correct a waveform of only either one of a waveform part in which a sample value increases and a waveform part in which a sample value decreases. It is desirable to correct waveforms of both a waveform part in which a sample value increases and a waveform part in which a sample value decreases, and to add both even-numbered harmonics and odd-numbered harmonics to a digital audio signal.

A first aspect of one or more embodiments provides a digital audio processing device that includes a local maximum sample detector that calculates a local maximum in a sample constituting a digital audio signal that is input and detects a local maximum sample including the local maximum, a local minimum sample detector that calculates a local minimum in the sample constituting the digital audio signal and detects a local minimum sample including the local minimum, a waveform slope determiner that determines whether the sample constituting the digital audio signal is a waveform part in which a sample value increases from the local minimum sample to the local maximum sample, or a waveform part in which the sample value decreases from the local maximum sample to the local minimum sample, a counter that counts a sample interval between the local minimum sample and the local maximum sample that are adjacent to each other in a time direction, a coefficient selector that selects a coefficient for even-numbered harmonics and a coefficient for odd-numbered harmonics according to the sample interval counted by the counter, and a harmonic component adder that includes an even-numbered harmonic adder that adds an even-numbered harmonic to the digital audio signal, and an odd-numbered harmonic adder that adds an odd-numbered harmonic to the digital audio signal, the harmonic component adder adding a harmonic component including the even-numbered harmonic and the odd-numbered harmonic to the digital audio signal and outputting the digital audio signal In the digital audio processing device described above, if the sample constituting the digital audio signal increases from a first local minimum sample to a first local maximum sample and decreases from the first local maximum sample to a second local minimum sample, the even-numbered harmonic adder performs either one of a first even-numbered harmonic addition process and a second even-numbered harmonic addition process.

The even-numbered harmonic adder of the above described digital audio processing device performs the first even-numbered harmonic addition process for adding the even-numbered harmonic to the digital audio signal by adding, to a first adjacent sample that is a next sample that follows the first local minimum sample, a first correction value obtained by multiplying a first difference value between the first local minimum sample and the first adjacent sample by a first coefficient for even-numbered harmonics that is selected by the coefficient selector according to a first sample interval between the first local minimum sample and the first local maximum sample, subtracting, from a second adjacent sample that is one sample before the first local maximum sample, a second correction value obtained by multiplying a second difference value between the second adjacent sample and the first local maximum sample by the first coefficient for even-numbered harmonics, adding, to a third adjacent sample that is a next sample that follows the first local maximum sample, a third correction value obtained by multiplying a third difference value between the first local maximum sample and the third adjacent sample by a second coefficient for even-numbered harmonics selected by the coefficient selector according to a second sample interval between the first local maximum sample and the second local minimum sample, and subtracting, from a fourth adjacent sample that is one sample before the second local minimum sample, a fourth correction value obtained by multiplying a fourth difference value between the fourth adjacent sample and the second local minimum sample by the second coefficient for even-numbered harmonics.

The even-numbered harmonic adder of the above described digital audio processing device performs the second even-numbered harmonic addition process for adding the even-numbered harmonic to the digital audio signal by subtracting the first correction value from the first adjacent sample, by adding the second correction value to the second adjacent sample, subtracting the third correction value from the third adjacent sample, and adding the fourth correction value to the fourth adjacent sample.

The odd-numbered harmonic adder of the above described digital audio processing device performs an odd-numbered harmonic addition process for adding the odd-numbered harmonic to the digital audio signal by subtracting, from the first local minimum sample, a fifth correction value obtained by multiplying a fifth difference value between the first local minimum sample and a fifth adjacent sample that is one sample before the first local minimum sample by a first coefficient for odd-numbered harmonics selected by the coefficient selector according to a third sample interval between the first local minimum sample and a second local maximum sample immediately before the first local minimum sample, adding, to the first local maximum sample, a sixth correction value obtained by multiplying the second difference value by a second coefficient for odd-numbered harmonics selected by the coefficient selector according to the first sample interval, and subtracting, from the second local minimum sample, a seventh correction value obtained by multiplying the fourth difference value by a third coefficient for odd-numbered harmonics selected by the coefficient selector according to the second sample interval.

A second aspect of one or more embodiments provides a digital audio processing method that includes calculating a local maximum in a sample constituting a digital audio signal that is input and detecting a local maximum sample including the local maximum, calculating a local minimum in the sample constituting the digital audio signal and detecting a local minimum sample including the local minimum, determining whether the sample constituting the digital audio signal is a waveform part in which a sample value increases from the local minimum sample to the local maximum sample, or a waveform part in which the sample value decreases from the local maximum sample to the local minimum sample, and counting a sample interval between the local minimum sample and the local maximum sample that are adjacent to each other in a time direction.

In the above described digital audio processing method, if the sample constituting the digital audio signal increases from a first local minimum sample to a first local maximum sample and decreases from the first local maximum sample to a second local minimum sample, either one of a first even-numbered harmonic addition process and a second even-numbered harmonic addition process is performed.

In the above described digital audio processing method, the first even-numbered harmonic addition process for adding the even-numbered harmonic to the digital audio signal is performed by adding, to a first adjacent sample that is a next sample that follows the first local minimum sample, a first correction value obtained by multiplying a first difference value between the first local minimum sample and the first adjacent sample by a first coefficient for even-numbered harmonics that is selected according to a first sample interval between the first local minimum sample and the first local maximum sample, subtracting, from a second adjacent sample that is one sample before the first local maximum sample, a second correction value obtained by multiplying a second difference value between the second adjacent sample and the first local maximum sample by the first coefficient for even-numbered harmonics, adding, to a third adjacent sample that is a next sample that follows the first local maximum sample, a third correction value obtained by multiplying a third difference value between the first local maximum sample and the third adjacent sample by a second coefficient for even-numbered harmonics that is selected according to a second sample interval between the first local maximum sample and the second local minimum sample, and subtracting, from a fourth adjacent sample that is one sample before the second local minimum sample, a fourth correction value obtained by multiplying a fourth difference value between the fourth adjacent sample and the second local minimum sample by the second coefficient for even-numbered harmonics.

In the above described digital audio processing method, the second even-numbered harmonic addition process for adding the even-numbered harmonic to the digital audio signal is performed by subtracting the first correction value from the first adjacent sample, adding the second correction value to the second adjacent sample, subtracting the third correction value from the third adjacent sample, and adding the fourth correction value to the fourth adjacent sample.

In the above described digital audio processing method, an odd-numbered harmonic addition process for adding the odd-numbered harmonic to the digital audio signal is performed by subtracting, from the first local minimum sample, a fifth correction value obtained by multiplying a fifth difference value between the first local minimum sample and a fifth adjacent sample that is one sample before the first local minimum sample by a first coefficient for odd-numbered harmonics that is selected according to a third sample interval between the first local minimum sample and a second local maximum sample immediately before the first local minimum sample, adding, to the first local maximum sample, a sixth correction value obtained by multiplying the second difference value by a second coefficient for odd-numbered harmonics that is selected according to the first sample interval, and, subtracting, from the second local minimum sample, a seventh correction value obtained by multiplying the fourth difference value by a third coefficient for odd-numbered harmonics that is selected according to the second sample interval.

A third aspect of one or more embodiments provides a digital audio processing program stored in a non-transitory storage medium causing a computer to execute the steps of: calculating a local maximum in a sample constituting a digital audio signal that is input and detecting a local maximum sample including the local maximum, calculating a local minimum in the sample constituting the digital audio signal and detecting a local minimum sample including the local minimum, determining whether the sample constituting the digital audio signal is a waveform part in which a sample value increases from the local minimum sample to the local maximum sample, or a waveform part in which the sample value decreases from the local maximum sample to the local minimum sample, and counting a sample interval between the local minimum sample and the local maximum sample that are adjacent to each other in a time direction.

The above described digital audio processing program causes a computer to perform either a first even-numbered harmonic addition step and a second even-numbered harmonic addition step, if the sample constituting the digital audio signal increases from a first local minimum sample to a first local maximum sample and decreases from the first local maximum sample to a second local minimum sample.

The above described digital audio processing program causes a computer to perform the first even-numbered harmonic addition step for adding the even-numbered harmonic to the digital audio signal by adding, to a first adjacent sample that is a next sample that follows the first local minimum sample, a first correction value obtained by multiplying a first difference value between the first local minimum sample and the first adjacent sample by a first coefficient for even-numbered harmonics that is selected according to a first sample interval between the first local minimum sample and the first local maximum sample, subtracting, from a second adjacent sample that is one sample before the first local maximum sample, a second correction value obtained by multiplying a second difference value between the second adjacent sample and the first local maximum sample by the first coefficient for even-numbered harmonics, adding, to a third adjacent sample that is a next sample that follows the first local maximum sample, a third correction value obtained by multiplying a third difference value between the first local maximum sample and the third adjacent sample by a second coefficient for even-numbered harmonics that is selected according to a second sample interval between the first local maximum sample and the second local minimum sample, and subtracting, from a fourth adjacent sample that is one sample before the second local minimum sample, a fourth correction value obtained by multiplying a fourth difference value between the fourth adjacent sample and the second local minimum sample by the second coefficient for even-numbered harmonics.

The above described digital audio processing program causes a computer to perform the second even-numbered harmonic addition step for adding the even-numbered harmonic to the digital audio signal by subtracting the first correction value from the first adjacent sample, adding the second correction value to the second adjacent sample, subtracting the third correction value from the third adjacent sample, and adding the fourth correction value to the fourth adjacent sample.

The above described digital audio processing program causes a computer to perform an odd-numbered harmonic addition step for adding the odd-numbered harmonic to the digital audio signal, including the steps of subtracting, from the first local minimum sample, a fifth correction value obtained by multiplying a fifth difference value between the first local minimum sample and a fifth adjacent sample that is one sample before the first local minimum sample by a first coefficient for odd-numbered harmonics that is selected according to a third sample interval between the first local minimum sample and a second local maximum sample immediately before the first local minimum sample, adding, to the first local maximum sample, a sixth correction value obtained by multiplying the second difference value by a second coefficient for odd-numbered harmonics that is selected according to the first sample interval, and subtracting, from the second local minimum sample, a seventh correction value obtained by multiplying the fourth difference value by a third coefficient for odd-numbered harmonics that is selected according to the second sample interval.

BRIEF DESCRIPTION OF THE DRAWINGS

FIG. 3 is a diagram illustrating an example of a coefficient table indicating a coefficient set for each sample interval between a local maximum sample and a local minimum sample.

DETAILED DESCRIPTION

A description is given for a digital audio processing to device, a digital audio processing method, and a digital audio processing program according to one or more embodiments below with reference to the accompanying drawings.

Figure 1:
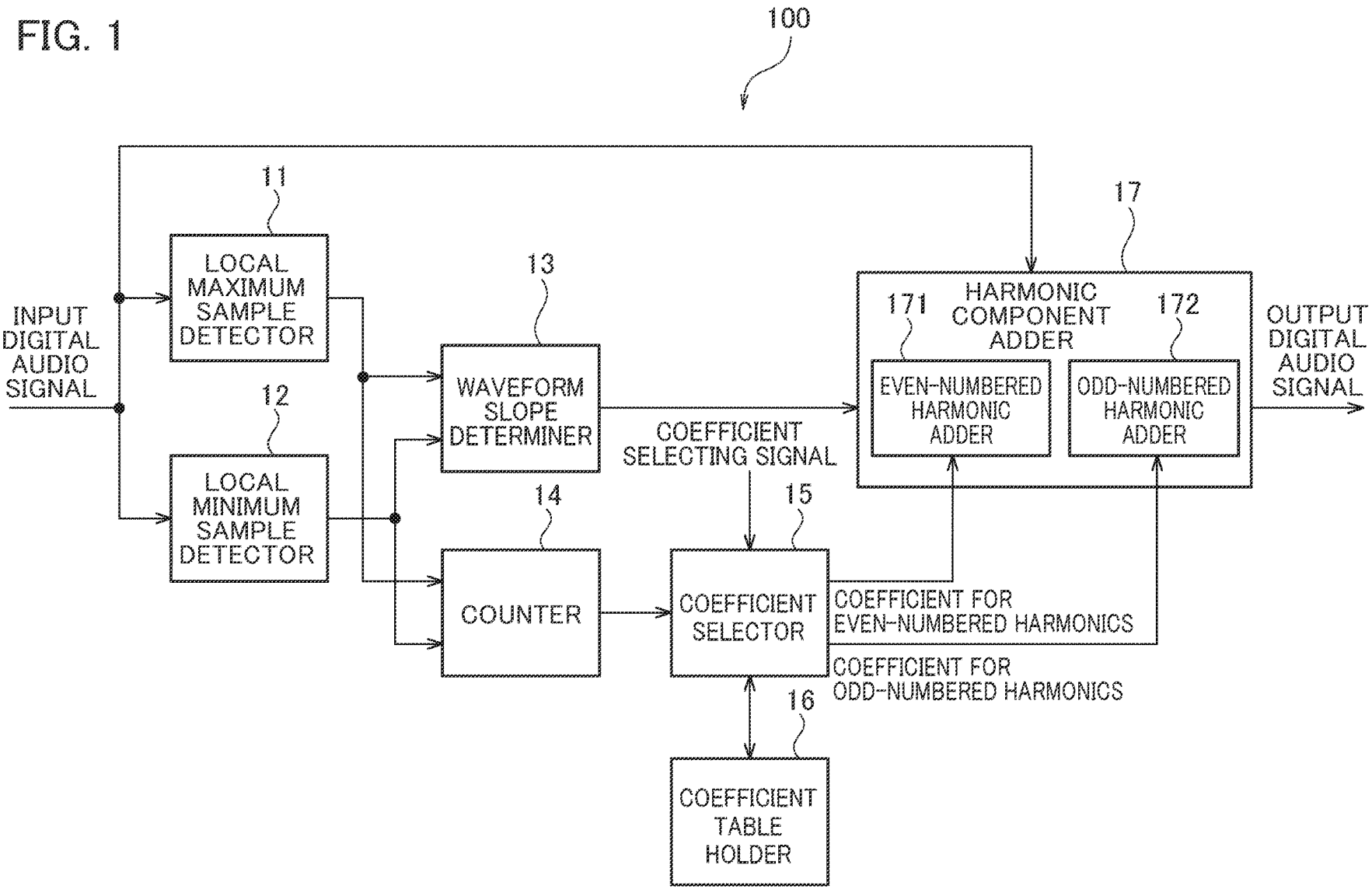
FIG. 1 is a block diagram illustrating a digital audio processing device according to one or more embodiments.

In FIG. 1, a digital audio processing device 100 according to one or more embodiments includes a local maximum sample detector 11, a local minimum sample detector 12, a waveform slope determiner 13, a counter 14, a coefficient selector 15, a coefficient table holder 16, and a harmonic component adder 17. The harmonic component adder 17 includes an even-numbered harmonic adder 171 and an odd-numbered harmonic adder 172. The digital audio processing device 100 may be configured by hardware including circuits, software, or the combination of hardware and software. The digital audio processing device 100 may be configured as an integrated circuit.

A digital audio signal with a predetermined number of quantization bits and a predetermined sampling frequency is input to the local maximum sample detector 11 and the local minimum sample detector 12. The local maximum sample detector 11 detects a local maximum sample having a local maximum by determining the magnitude relationship between adjacent samples in the input digital audio signal. The local minimum sample detector 12 similarly detects a local minimum sample having a local minimum. The local maximum sample and the local minimum sample are supplied to the waveform slope determiner 13 and the counter 14.

The waveform slope determiner 13 determines whether a waveform part between the samples is a waveform part in which a sample value increases or a waveform part in which a sample value decreases based on the order in which the local maximum sample and the local minimum sample are input. If the local maximum sample is input next to the local minimum sample, the waveform slope determiner 13 determines that the waveform part between the local minimum sample and the local maximum sample is a waveform part in which a sample value increase. If the local minimum sample is input next to the local maximum sample, the waveform slope determiner 13 determines that the waveform part between the local maximum sample and the local minimum sample is a waveform part in which a sample value decreases. The result of the determination by the waveform slope determiner 13 is supplied to the harmonic component adder 17.

Figure 2:
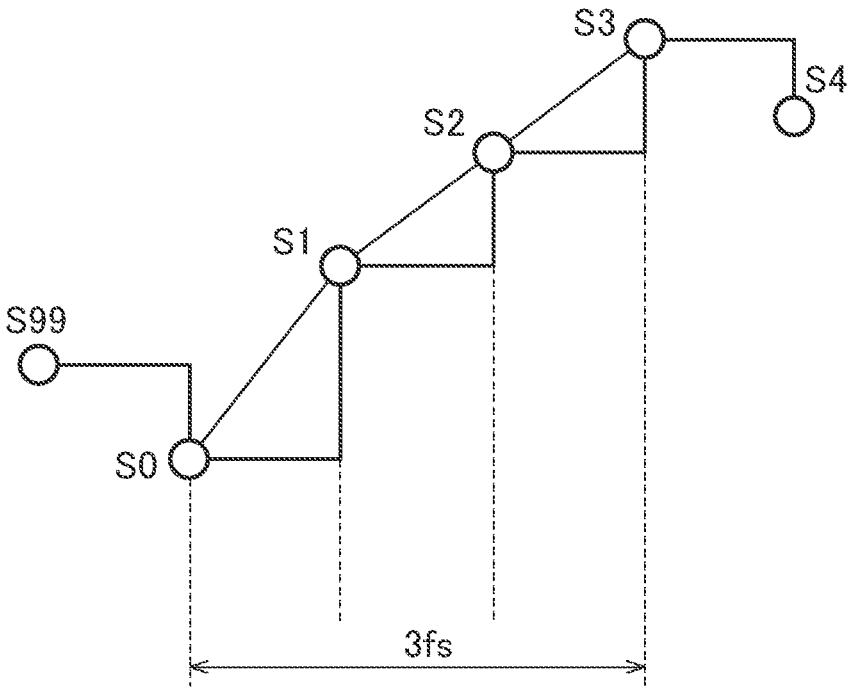
FIG. 2 is a waveform diagram illustrating an example of a digital audio signal input to a digital audio processing device according to one or more embodiments.

The counter 14 detects a sample interval between a local minimum sample and a local maximum sample. FIG. 2 shows an example of a waveform of a digital audio signal input to the digital audio processing device 100. In FIG. 2, a sample S0 is a local minimum sample and a sample S3 is a local maximum sample. A sample interval between the local minimum sample S0 and the local maximum sample S3 shown in FIG. 2 is 3. If an interval between adjacent local minimum sample and local maximum sample is denoted by fs, an interval between the local minimum sample S0 and the local maximum sample S3 shown in FIG. 2 is 3 fs.

Note that the sample interval between the local minimum sample and the local maximum sample includes both a sample interval between the local minimum sample and the local maximum sample of a waveform part in which a sample value increases and a sample interval between the local maximum sample and the local minimum sample of a waveform part in which a sample value decreases.

The sample interval detected by the counter 14 is supplied to the coefficient selector 15. A coefficient selecting signal set by a user is input to the coefficient selector 15. The coefficient table holder 16 holds a coefficient table as shown in FIG. 3. The coefficient table shows coefficients according to sample intervals and coefficient selecting signals, the coefficients being used when generating correction values to be added to or subtracted from samples which will be described later.

In FIG. 3, two samples to eight samples are shown as sample intervals, and coefficients of ½ to 1/128 are set corresponding to coefficient selecting signals "00", "01", "10", and "11". Each coefficient shown in FIG. 3 is merely an example, and coefficients are not limited to those shown in FIG. 3. The maximum sample interval is not limited to eight samples. The coefficient selecting signals "00", "01", "10", and "11" function as level selecting signals for selecting the levels of correction values.

If the coefficient selecting signal "00" is set, the degree of correction of a digital audio signal becomes the maximum, and alternatively if the coefficient selecting signal "11" is set, the degree of correction of a digital audio signal becomes the minimum. It is not essential to adjust a correction value by selecting a coefficient depending on a coefficient selecting signal, but it is preferable if the correction value is adjustable. If a coefficient is not selected depending on a coefficient selecting signal, it is sufficient if a coefficient of any one of the coefficient selecting signals "00", "01", "10", and "11" is set in the coefficient table.

The coefficients shown in FIG. 3 are coefficients for even-numbered harmonics used when the even-numbered harmonic adder 171 adds even-numbered harmonics to a digital audio signal, and are coefficients for odd-numbered harmonics used when the odd-numbered harmonic adder 172 adds odd-numbered harmonics to a digital audio signal. The coefficients for even-numbered harmonics and the coefficients for odd-numbered harmonics may be the same, or may be different.

Referring back to FIG. 1, the coefficient selector 15 reads out, from the coefficient table, the coefficients for even-numbered harmonics to be used by the even-numbered harmonic adder 171 and the coefficients for odd-numbered harmonics to be used by the odd-numbered harmonic adder 172 based on the sample interval supplied from the counter 14 and the coefficient selecting signal. The read coefficients for even-numbered harmonics and coefficients for odd-numbered harmonics are respectively supplied to the even-numbered harmonic adder 171 and the odd-numbered harmonic adder 172.

Figure 4:
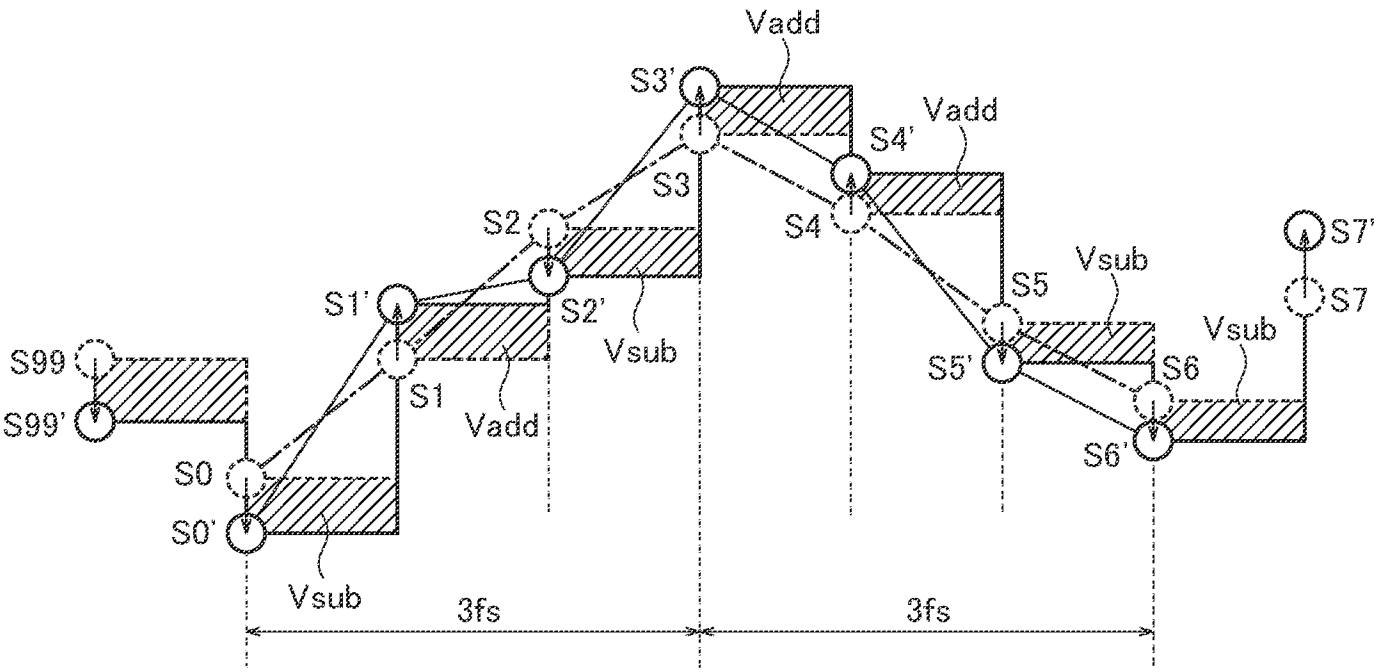
FIG. 4 is a waveform diagram illustrating a first even-numbered harmonic addition process and an odd-numbered harmonic addition process when a sample interval is 3 fs.

With reference to FIGS. 4 to 9, specific operations of the even-numbered harmonic adder 171 and the odd-numbered harmonic adder 172 will be described. In FIG. 4, circles shown with solid lines or dashed lines indicate samples. Samples shown with dashed lines indicate samples before correction. Alternatively, samples shown with solid lines indicate samples after correction. A sample interval between the local minimum sample S0 and the local maximum sample S3, and a sample interval between the local maximum sample S3 and a local minimum sample S6 are both 3 fs. It is assumed that a coefficient selecting signal is set to "00".

The even-numbered harmonic adder 171 adds a correction value Vadd to a sample S1 that immediately follows the local minimum samples S0, the correction value Vadd being obtained by multiplying a difference value between the local minimum sample S0 and the sample S1 by a coefficient. The sample S1 is corrected to a sample S1' by the addition of the correction value Vadd to the sample S1. Further, the even-numbered harmonic adder 171 subtracts a correction value Vsub from a sample S2 that immediately precedes the local maximum sample S3, the correction value Vsub being obtained by multiplying a difference value between the sample S2 and the local maximum sample S3 by a coefficient. The sample S2 is corrected to a sample S2' by subtraction of the correction value Vsub from the sample S2.

The correction value Vadd added to the sample S1 is ½ of the difference value between the local minimum sample S0 and the sample S1. The correction value Vsub subtracted from the sample S2 is ½ of the difference value between the sample S2 and the local maximum sample S3.

Further, the even-numbered harmonic adder 171 adds a correction value Vadd to a sample S4 that immediately follows the local maximum sample S3, the correction value Vadd being obtained by multiplying the difference value between the local maximum sample S3 and the sample S4 by a coefficient. The sample S4 is corrected to a sample S4' by the addition of the correction value Vadd to the sample S4. Further, the even-numbered harmonic adder 171 subtracts a correction value Vsub from a sample S5 that immediately precedes the local minimum sample S6, the correction value Vsub being obtained by multiplying the difference value between the sample S5 and the local minimum sample S6 by a coefficient. The sample S5 is corrected to a sample S5' by subtraction of the correction value Vsub from the sample S5.

The correction value Vadd added to the sample S4 is ½ of the difference value between the local maximum sample S3 and the sample S4. The correction value Vsub subtracted from the sample S5 is ½ of the difference value between the sample S5 and the local minimum sample S6.

The odd-numbered harmonic adder 172 subtracts a correction value Vsub from the local minimum sample S0, the correction value Vsub being obtained by multiplying the difference value between the local minimum sample S0 and a sample S99 that immediately precedes the local minimum sample S0 by a coefficient. The local minimum sample S0 is corrected to a local minimum sample S0' by subtraction of the correction value Vsub from the local minimum sample S0. Suppose that a sample interval between the local minimum sample S0 and an adjacent local maximum sample that immediately precedes the local minimum sample S0 is 3 fs. In the above case, the correction value Vsub subtracted from the local minimum sample S0 is ½ of the difference value between the sample S99 and the local minimum sample S0.

In addition, the odd-numbered harmonic adder 172 adds a correction value Vadd to the local maximum sample S3, the correction value Vadd being obtained by multiplying the difference value between the sample S2 and the local maximum sample S3 by a coefficient. The local maximum sample S3 is corrected to a local maximum sample S3' by addition of the correction value Vadd to the local maximum sample S3. The correction value Vadd added to the local maximum sample S3 is ½ of the difference value between the sample S2 and the local maximum sample S3.

Further, the odd-numbered harmonic adder 172 subtracts a correction value Vsub from the local minimum sample S6, the correction value Vsub being obtained by multiplying a difference value between the local minimum sample S6 and a sample S5 that immediately precedes the local minimum sample S6 by a coefficient. The local minimum sample S6 is corrected to a local minimum sample S6' by subtraction of the correction value Vsub from the local minimum sample S6. The correction value Vsub subtracted from the local minimum sample S6 is ½ of the difference value between the local minimum sample S6 and the sample S5.

As described above, the harmonic component adder 17 adds the correction value Vadd to or subtracts the correction value Vsub from a sample to be corrected of a digital audio signal. This corrects a waveform indicated by a one-dash chain line to a waveform indicated by a solid line. The even-numbered harmonic adder 171 and the odd-numbered harmonic adder 172 correct a digital audio signal in the same manner at or after a sample S7 also. This adds a harmonic component including an even-numbered harmonic and an odd-numbered harmonic to a digital audio signal.

Figure 5:
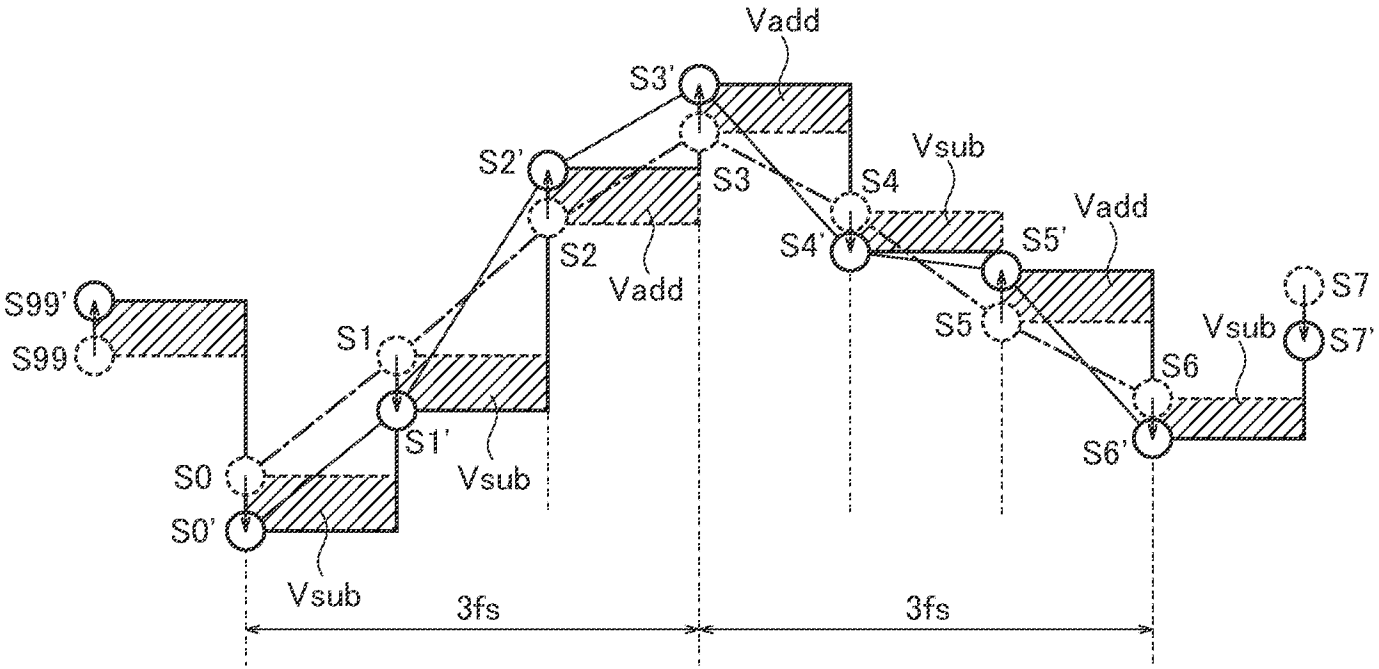
FIG. 5 is a waveform diagram illustrating a second even-numbered harmonic addition process and an odd-numbered to harmonic addition process when a sample interval is 3 fs.

As shown in FIG. 5, the harmonic component adder 17 may add the correction value Vadd to or subtract the correction value Vsub from a sample to be corrected to correct a digital audio signal. Similarly, it is assumed that a coefficient selecting signal is set to "00".

The even-numbered harmonic adder 171 subtracts a correction value Vsub from the sample S1, the correction value Vsub being obtained by multiplying the difference value between the local minimum sample S0 and the sample S1 by a coefficient. The sample S1 is corrected to a sample S1' by subtraction of the correction value Vsub from the sample S1. Further, the even-numbered harmonic adder 171 adds a correction value Vadd to the sample S2, the correction value Vadd being obtained by multiplying the difference value between the sample S2 and the local maximum sample S3 by a coefficient. The sample S2 is corrected to a sample S2' by addition of the correction value Vadd to the sample S2.

The correction value Vsub subtracted from the sample S1 is ½ of the difference value between the local minimum sample S0 and the sample S1. The correction value Vadd added to the sample S2 is ½ of the difference value between the sample S2 and the local maximum sample S3.

Further, the even-numbered harmonic adder 171 subtracts a correction value Vsub from the sample S4, the correction value Vsub being obtained by multiplying the difference value between the local maximum sample S3 and the sample S4 by a coefficient. The sample S4 is corrected to a sample S4' by subtraction of the correction value Vsub from the sample S4. Further, the even-numbered harmonic adder 171 adds a correction value Vadd to the sample S5, the correction value Vadd being obtained by multiplying the difference value between the sample S5 and the local minimum sample S6 by a coefficient. The sample S5 is corrected to a sample S5' by addition of the correction value Vadd to the sample S5.

The correction value Vsub subtracted from the sample S4 is ½ of the difference value between the local maximum sample S3 and the sample S4. The correction value Vadd added to the sample S5 is ½ of the difference value between the sample S5 and the local minimum sample S6.

The odd-numbered harmonic adder 172 subtracts a correction value Vsub from the local minimum sample S0, the correction value Vsub being obtained by multiplying the difference value between the sample S99 and the local minimum sample S0 by a coefficient. The local minimum sample S0 is corrected to a local minimum sample S0' by subtraction of the correction value Vsub from the local minimum sample S0. Suppose that a sample interval between the local minimum sample S0 and an adjacent local maximum sample that immediately precedes the local minimum sample S0 is 3 fs. In the above case, the correction value Vsub subtracted from the local minimum sample S0 is ½ of the difference value between the local minimum sample S0 and the sample S99.

In addition, the odd-numbered harmonic adder 172 adds a correction value Vadd to the local maximum sample S3, the correction value Vadd being obtained by multiplying the difference value between the sample S2 and the local maximum sample S3 by a coefficient. The local maximum sample S3 is corrected to a local maximum sample S3' by addition of the correction value Vadd to the local maximum sample S3. The correction value Vadd added to the local maximum sample S3 is ½ of the difference value between the sample S2 and the local maximum sample S3.

Furthermore, the odd-numbered harmonic adder 172 subtracts a correction value Vsub from the local minimum sample S6, the correction value Vsub being obtained by multiplying the difference value between the sample S5 and the local minimum sample S6 by a coefficient. The local minimum sample S6 is corrected to a local minimum sample S6' by subtraction of the correction value Vsub from the local minimum sample S6. The correction value Vsub subtracted from the local minimum sample S6 is ½ of the difference value between the sample S5 and the local minimum sample S6.

As described above, the harmonic component adder 17 adds the correction value Vadd to or subtracts the correction value Vsub from a sample to be corrected of a digital audio signal. This corrects a waveform indicated by a one-dash chain line to a waveform indicated by a solid line. The even-numbered harmonic adder 171 and the odd-numbered harmonic adder 172 correct a digital audio signal in the same manner at or after a sample S7 also. This adds a harmonic component including an even-numbered harmonic and an odd-numbered harmonic to a digital audio signal.

As shown in FIG. 4 or 5, the digital audio processing device 100 corrects both of a waveform part in which a sample value increases and a waveform part in which a sample value decreases. Accordingly, it is possible to add a harmonic component including both of an even-numbered harmonic and an odd-numbered harmonic to a digital audio signal.

The even-numbered harmonic adder 171 may use only a sample that immediately precedes a local minimum sample and a sample that immediately follows the local minimum sample, and a sample that immediately precedes a local maximum sample and a sample that immediately follows the local maximum sample as samples to be corrected, even if a sample interval between the local minimum sample and the local maximum sample is any of 3 fs to 8 fs.

If the sample interval between the local minimum sample and the local maximum sample is, for example, in a range from 6 fs to 8 fs, the even-numbered harmonic adder 171 may add, to the samples to be corrected, a sample which is two samples before the local minimum sample and a sample which is two samples after the local minimum sample, and a sample which is two samples before the local maximum sample and a sample which is two samples after the local maximum sample.

Figure 6:
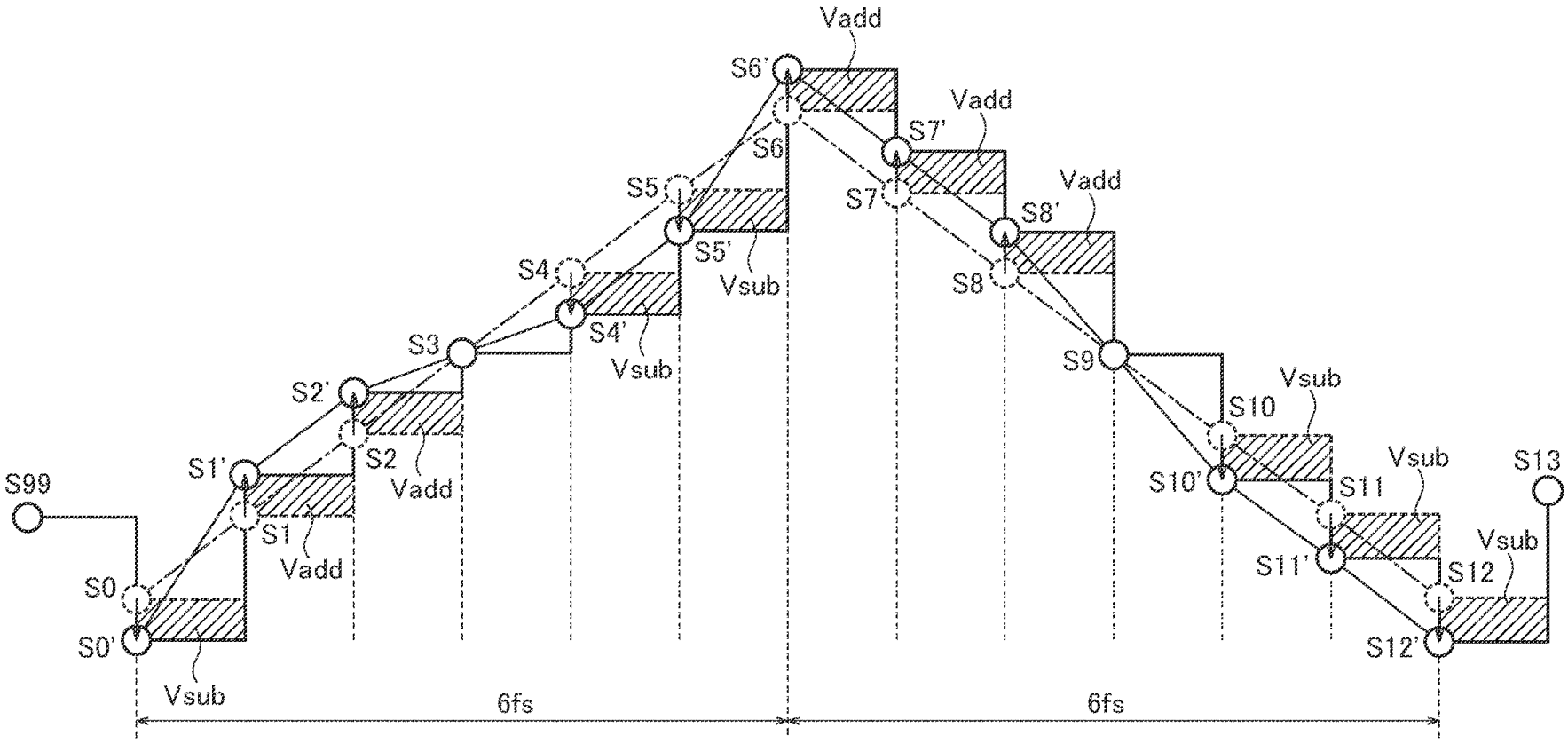
FIG. 6 is a waveform diagram illustrating a first even-numbered harmonic addition process and an odd-numbered harmonic addition process when a sample interval is 6 fs.

With reference to FIG. 6, a description will be given regarding an operation of the even-numbered harmonic adder 171 in a case where the even-numbered harmonic adder 171 uses a total of four samples of two samples before and after a local minimum sample and a total of four samples of two samples before and after a local maximum sample, as samples to be corrected. FIG. 6 corresponds to an addition method obtained by increasing the number of samples in the addition method of an even-numbered harmonic shown in FIG. 4 to four. In FIG. 6, the correction values and the corrected samples are shown only for the samples in the range from the local minimum sample S0 to the next local minimum sample S12.

The even-numbered harmonic adder 171 adds a correction value Vadd to the sample S1, the correction value Vadd being obtained by multiplying the difference value between the local minimum sample S0 and the sample S1 by a coefficient. The even-numbered harmonic adder 171 adds a correction value Vadd to the sample S2, the correction value Vadd being obtained by multiplying the difference value between the sample S1 and the sample S2 by a coefficient. The samples S1 and S2 are corrected to samples S1' and S2' respectively by addition of the correction value Vadd. Further, the even-numbered harmonic adder 171 subtracts a correction value Vsub from the sample S4, the correction value Vsub being obtained by multiplying the difference value between the sample S4 and the sample S5 by a coefficient. The even-numbered harmonic adder 171 subtracts a correction value Vsub from the sample S5, the correction value Vsub being obtained by multiplying the difference value between the sample S5 and a local maximum sample S6 by a coefficient. The samples S4 and S5 are corrected to samples S4' and S5' respectively by subtraction of the correction value Vsub.

Further, the even-numbered harmonic adder 171 adds a correction value Vadd to the sample S7, the correction value Vadd being obtained by multiplying the difference value between the local maximum sample S6 and the sample S7 by a coefficient. The even-numbered harmonic adder 171 adds a correction value Vadd to the sample S8, the correction value Vadd being obtained by multiplying the difference value between the sample S7 and the sample S8 by a coefficient. The samples S7 and S8 are corrected to samples S7' and S8' respectively by addition of the correction value Vadd. The even-numbered harmonic adder 171 subtracts a correction value Vsub from the sample S10, the correction value Vsub being obtained by multiplying a difference value between the sample S10 and the sample S11 by a coefficient. The even-numbered harmonic adder 171 subtracts a correction value Vsub from the sample S11, the correction value Vsub being obtained by multiplying a difference value between the sample S11 and the local minimum sample S12 by a coefficient. The samples S10 and S11 are corrected to samples S10' and S11' respectively by subtraction of the correction value Vsub.

The odd-numbered harmonic adder 172 subtracts the correction value Vsub from the local minimum sample S0, the correction value Vsub being obtained by multiplying the difference value between the sample S99 and the local minimum sample S0 by a coefficient. The local minimum sample S0 is corrected to the local minimum sample S0' by the subtraction of the correction value Vsub. The odd-numbered harmonic adder 172 adds the correction value Vadd to the local maximum sample S6, the correction value Vadd being obtained by multiplying the difference value between the sample S5 and the local maximum sample S6 by a coefficient. The local maximum sample S6 is corrected to a local maximum sample S6' by addition of the correction value Vadd. The odd-numbered harmonic adder 172 subtracts the correction value Vsub from the local minimum sample S12, the correction value Vsub being obtained by multiplying a difference value between a sample S11 and a local minimum sample S12 by a coefficient. The local minimum sample S12 is corrected to a local minimum sample S12' by subtraction of the correction value Vsub.

The harmonic component adder 17 adds the correction value Vadd to or subtracts the correction value Vsub from the sample to be corrected of the digital audio signal as described above. Accordingly, a waveform indicated by a one-dash chain line is corrected to a waveform indicated by a solid line.

Figure 7:
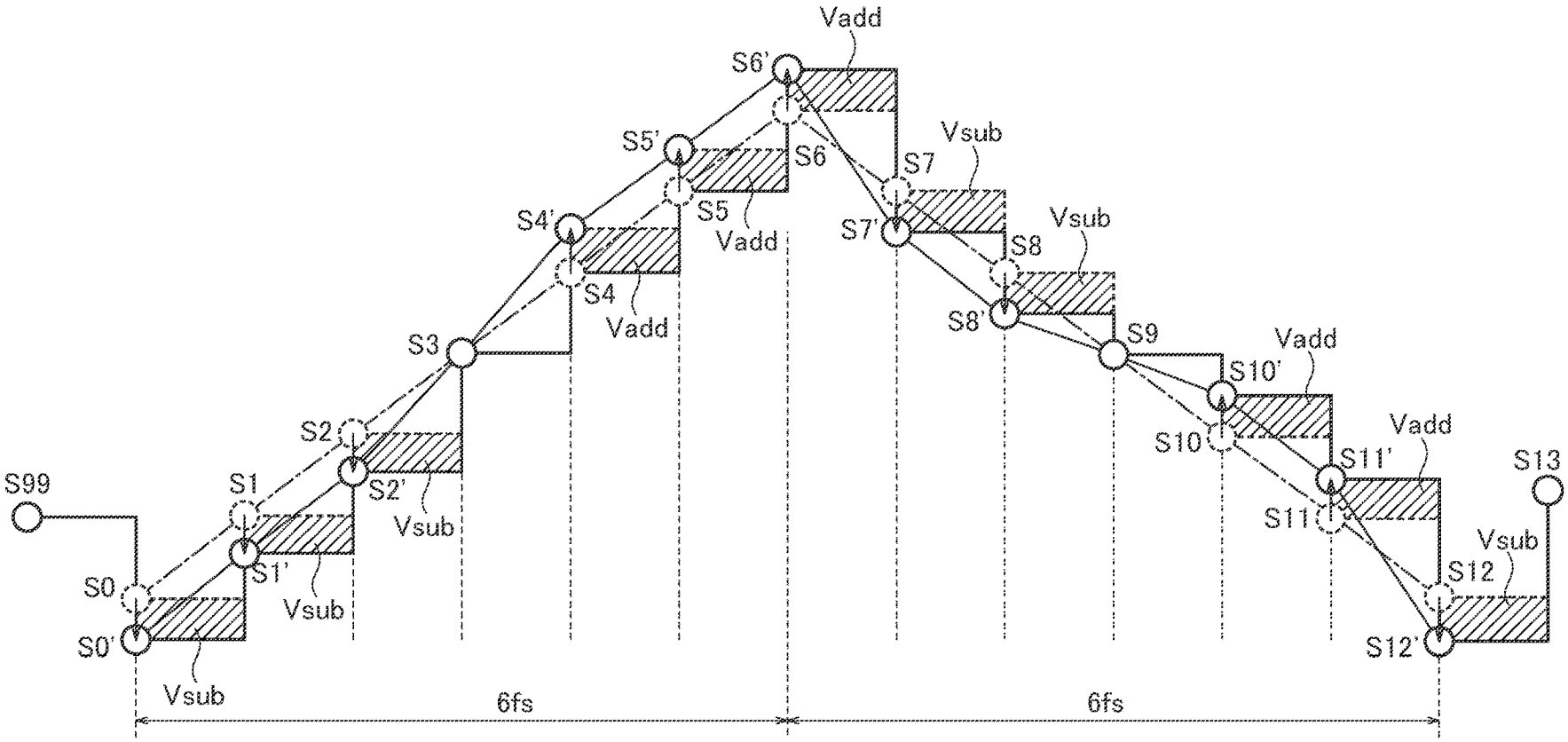
FIG. 7 is a waveform diagram illustrating a second even-numbered harmonic addition process and an odd-numbered harmonic addition process when a sample interval is 6 fs.

As shown in FIG. 7, the harmonic component adder 17 may add the correction value Vadd to or subtract the correction value Vsub from a sample to be corrected to correct a digital audio signal. FIG. 7 corresponds to an addition method obtained by increasing the number of samples in the addition method of an even-numbered harmonic shown in FIG. 5 to four.

The even-numbered harmonic adder 171 subtracts the correction value Vsub from the sample S1, the correction value Vsub being obtained by multiplying the difference value between the local minimum sample S0 and the sample S1 by a coefficient. The even-numbered harmonic adder 171 subtracts the correction value Vsub from the sample S2, the correction value Vsub being obtained by multiplying the difference value between the sample S1 and the sample S2 by a coefficient. The samples S1 and S2 are corrected to samples S1' and S2' respectively by subtraction of the correction value Vsub. Further, the even-numbered harmonic adder 171 adds the correction value Vadd to the sample S4, the correction value Vadd being obtained by multiplying a difference value between the sample S4 and the sample S5 by a coefficient. The even-numbered harmonic adder 171 adds the correction value Vadd to the sample S5, the correction value Vadd being obtained by multiplying a difference value between the sample S5 and the local maximum sample S6 by a coefficient. The samples S4 and S5 are corrected to samples S4' and S5' respectively by addition of the correction value Vadd.

Furthermore, the even-numbered harmonic adder 171 subtracts the correction value Vsub from the sample S7, the correction value Vsub being obtained by multiplying a difference value between the local maximum sample S6 and the sample S7 by the coefficient. The even-numbered harmonic adder 171 subtracts the correction value Vsub from the sample S8, the correction value Vsub being obtained by multiplying the difference value between the sample S7 and the sample S8 by a coefficient. Further, the even-numbered harmonic adder 171 adds the correction value Vadd to the sample S10, the correction value Vadd being obtained by multiplying the difference value between the sample S10 and the sample S11 by a coefficient. The even-numbered harmonic adder 171 adds the correction value Vadd to the sample S11, the correction value Vadd being obtained by multiplying a difference value between a sample S11 and the local minimum sample S12 by a coefficient. The samples S7 and S8 are corrected to samples S7' and S8' respectively by subtraction of the correction value Vsub. The samples S10 and S11 are corrected to samples S10' and S11' respectively by addition of the correction value Vadd.

The odd-numbered harmonic adder 172 subtracts the correction value Vsub from the local minimum sample S0, the correction value Vsub being obtained by multiplying a difference value between the sample S99 and the local minimum sample S0 by a coefficient. The local minimum sample S0 is corrected to the local minimum sample S0' by subtraction of the correction value Vsub. The odd-numbered harmonic adder 172 adds the correction value Vadd to the local maximum sample S6, the correction value Vadd being obtained by multiplying a difference value between the sample S5 and the local maximum sample S6 by a coefficient. The local maximum sample S6 is corrected to the local maximum sample S6' by addition of the correction value Vadd. The odd-numbered harmonic adder 172 subtracts the correction value Vsub from the local minimum sample S12, the correction value Vsub being obtained by multiplying a difference value between the sample S11 and the local minimum sample S12 by a coefficient. The local minimum sample S12 is corrected to the local minimum sample S12' by subtraction of the correction value Vsub.

The harmonic component adder 17 adds the correction value Vadd to or subtracts the correction value Vsub from a sample to be corrected of a digital audio signal as described above. Accordingly, a waveform indicated by a one-dash chain line is corrected to a waveform indicated by a solid line.

The even-numbered harmonic adder 171 may set 3 or more samples before and after a local minimum sample as samples to be corrected, and then add the correction value Vadd or subtract the correction value Vsub from the samples to be corrected. The number of samples to be corrected is a matter of design. As the sample interval increases, the number of samples to be corrected may be increased.

When the sample interval is 2 fs, an intermediate sample between a local minimum sample and a local maximum sample becomes a target sample to which the correction value Vadd is added and from which the correction value Vsub is subtracted. Therefore, when the sample interval is 2 fs, the even-numbered harmonic adder 171 may correct a digital audio signal as shown in FIG. 8 or 9.

Figure 8:
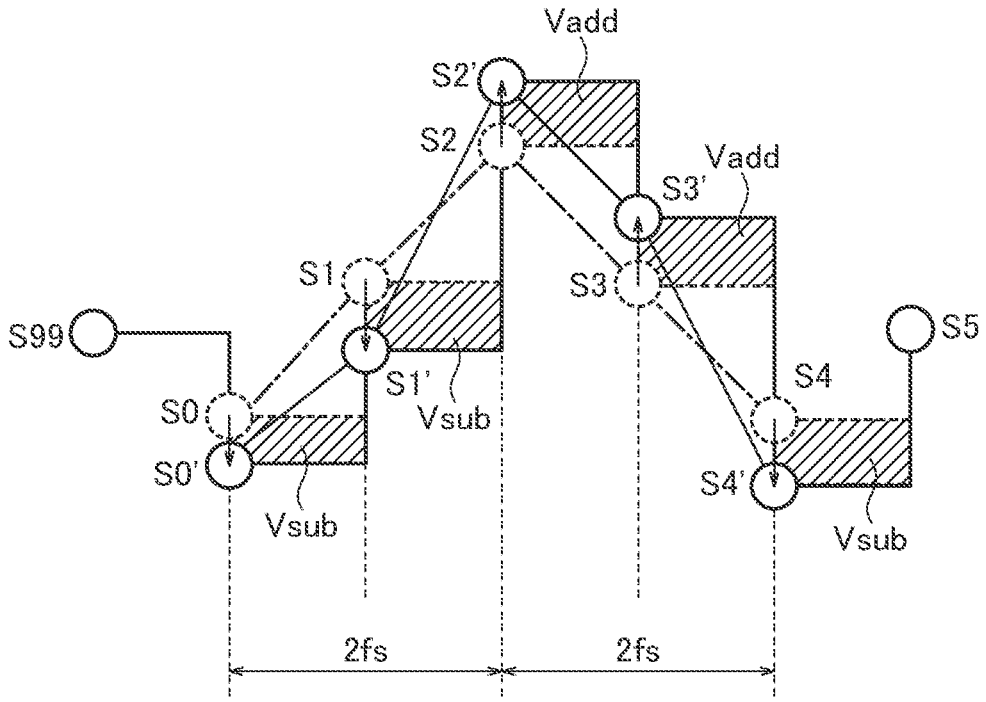
FIG. 8 is a waveform diagram illustrating a first even-numbered harmonic addition process and an odd-numbered harmonic addition process when a sample interval is 2 fs.

FIG. 8 corresponds to the addition method of an even-numbered harmonic shown in FIG. 4. In FIG. 8, the even-numbered harmonic adder 171 subtracts the correction value Vsub from the sample S1, the correction value Vsub being obtained by multiplying a difference value between the sample S1 and the local maximum sample S2 by a coefficient. The sample S1 is corrected to the sample S1' by subtraction of the correction value Vsub. Further, the even-numbered harmonic adder 171 adds the correction value Vadd to the sample S3, the correction value Vadd being obtained by multiplying a difference value between the local maximum sample S2 and the sample S3 by a coefficient. The sample S3 is corrected to the sample S3' by addition of the correction value Vadd.

The odd-numbered harmonic adder 172 subtracts the correction value Vsub from the local minimum sample S0, the correction value Vsub being obtained by multiplying a difference value between the sample S99 and the local minimum sample S0 by a coefficient. The local minimum sample S0 is corrected to the local minimum sample S0' by subtraction of the correction value Vsub. The odd-numbered harmonic adder 172 adds the correction value Vadd to the local maximum sample S2, the correction value Vadd being obtained by multiplying a difference value between the sample S1 and the local maximum sample S2 by a coefficient. The local maximum sample S2 is corrected to the local maximum sample S2' by addition of the correction value Vadd. The odd-numbered harmonic adder 172 subtracts the correction value Vsub from the local minimum sample S4, the correction value Vsub being obtained by multiplying a difference value between the sample S3 and the local minimum sample S4 by a coefficient. The local minimum sample S4 is corrected to the local minimum sample S4' by subtraction of the correction value Vsub.

Figure 9:
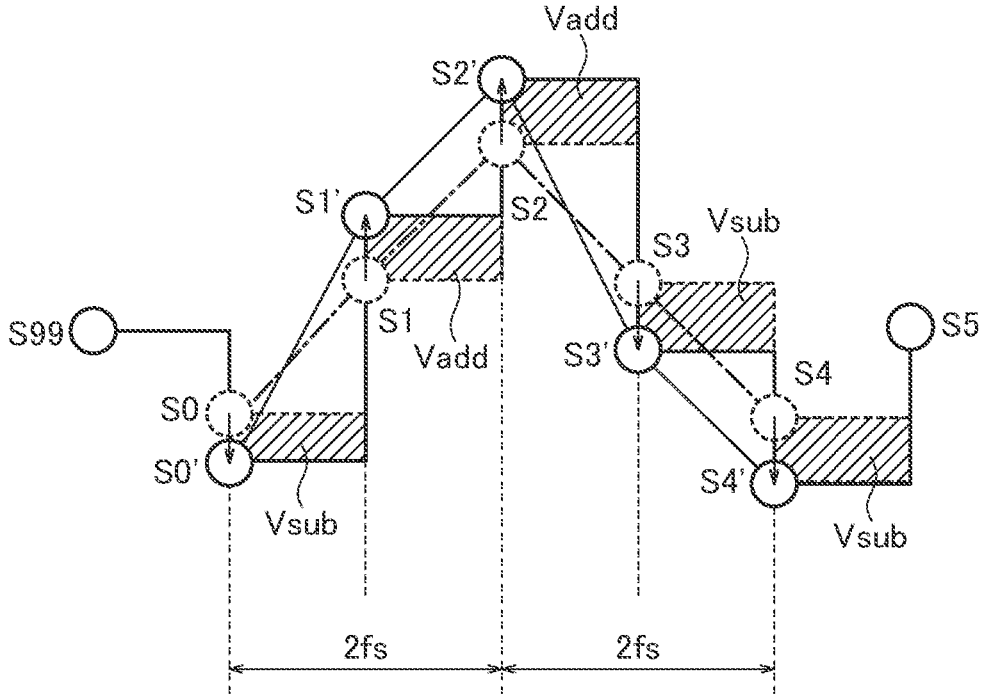
FIG. 9 is a waveform diagram illustrating a second even-numbered harmonic addition process and an odd-numbered harmonic addition process when a sample interval is 2 fs.

FIG. 9 corresponds to the addition method of an even-numbered harmonic shown in FIG. 5. In FIG. 9, the even-numbered harmonic adder 171 adds the correction value Vadd to the sample S1, the correction value Vadd being obtained by multiplying a difference value between the sample S1 and the local maximum sample S2 by a coefficient. The sample S1 is corrected to the sample S1' by addition of the correction value Vadd. Further, the even-numbered harmonic adder 171 subtracts the correction value Vsub from the sample S3, the correction value Vsub being obtained by multiplying a difference value between the local maximum sample S2 and the sample S3 by a coefficient. The sample S3 is corrected to the sample S3' by subtraction of the correction value Vsub. The operation of the odd-numbered harmonic adder 172 is the same as that in FIG. 8.

The operations of processing a digital audio signal having a sample interval of 3 fs or more by the digital audio processing device 100 are summarized as follows. Assume that a sample constituting a digital audio signal increases from a first local minimum sample to a first local maximum sample and then decreases from the first local maximum sample to a second local minimum sample. In FIGS. 4 and 5, the local minimum sample S0 is a first local minimum sample, the local maximum sample S3 is a first local maximum sample, and the local minimum sample S6 is a second local minimum sample. In FIGS. 6 and 7, the local minimum sample S0 is a first local minimum sample, the local maximum sample S6 is a first local maximum sample, and the local minimum sample S12 is a second local minimum sample.

The even-numbered harmonic adder 171 performs either one of a first even-numbered harmonic addition process and a second even-numbered harmonic addition process.

The first even-numbered harmonic addition process is as follows. The even-numbered harmonic adder 171 adds a first correction value to a first adjacent sample that is a next sample that follows the first local minimum sample, the first correction value being obtained by multiplying a first difference value between the first local minimum sample and the first adjacent sample by a first coefficient for even-numbered harmonics. The first coefficient for even-numbered harmonics is selected by a coefficient selector 15 according to a first sample interval between a first local minimum sample and a first local maximum sample. The even-numbered harmonic adder 171 subtracts a second correction value from a second adjacent sample that is one sample before the first local maximum sample, the second correction value being obtained by multiplying a second difference value between the second adjacent sample and a first local maximum sample by a first coefficient for even-numbered harmonics.

The even-numbered harmonic adder 171 adds a third correction value to a third adjacent sample that is a next sample that follows the first local maximum sample, the third correction value being obtained by multiplying a third difference value between the first local maximum sample and the third adjacent sample by a second coefficient for even-numbered harmonics. The second coefficient for even-numbered harmonics is selected by the coefficient selector 15 according to a second sample interval between the first local maximum sample and the second local minimum sample. The second coefficient for even-numbered harmonics may be the same as or different from the first coefficient for even-numbered harmonics. The even-numbered harmonic adder 171 subtracts a fourth correction value from a fourth adjacent sample that is one sample before the second local minimum sample, the fourth correction value being obtained by multiplying a fourth difference value between the fourth adjacent sample and a second local minimum sample by a second coefficient for even-numbered harmonics.

The second even-numbered harmonic addition process is as follows. The even-numbered harmonic adder 171 subtracts a first correction value from a first adjacent sample, and adds a second correction value to a second adjacent sample. The even-numbered harmonic adder 171 subtracts a third correction value from a third adjacent sample and adds a fourth correction value to a fourth adjacent sample.

The odd-numbered harmonic adder 172 performs an odd-numbered harmonic addition process below. The odd-numbered harmonic adder 172 subtracts a fifth correction value from the first local minimum sample, the fifth correction value being obtained by multiplying a fifth difference value between a first local minimum sample and a fifth adjacent sample that is one sample before the first local minimum sample by a first coefficient for odd-numbered harmonics. The first coefficient for odd-numbered harmonics is selected by the coefficient selector 15 according to a third sample interval between the first local minimum sample and the second local maximum sample immediately before the first local minimum sample.

The odd-numbered harmonic adder 172 adds a sixth correction value to the first local maximum sample, the sixth correction value being obtained by multiplying a second difference value by a second coefficient for odd-numbered harmonics. The second coefficient for odd-numbered harmonics is selected by the coefficient selector 15 according to the first sample interval. The second coefficient for odd-numbered harmonics is the same as the first coefficient for even-numbered harmonics. The odd-numbered harmonic adder 172 subtracts a seventh correction value from the second local minimum sample, the seventh correction value being obtained by multiplying the fourth difference value by a third coefficient for odd-numbered harmonics. The third coefficient for odd-numbered harmonics is selected by the coefficient selector 15 according to the second sample interval. The third coefficient for odd-numbered harmonics is the same as the second coefficient for even-numbered harmonics.

As described above, the harmonic component adder 17 having the even-numbered harmonic adder 171 and the odd-numbered harmonic adder 172 adds a harmonic component including an even-numbered harmonic and an odd-numbered harmonic to the received digital audio signal as an input and outputs the resultant signal.

Figure 10:
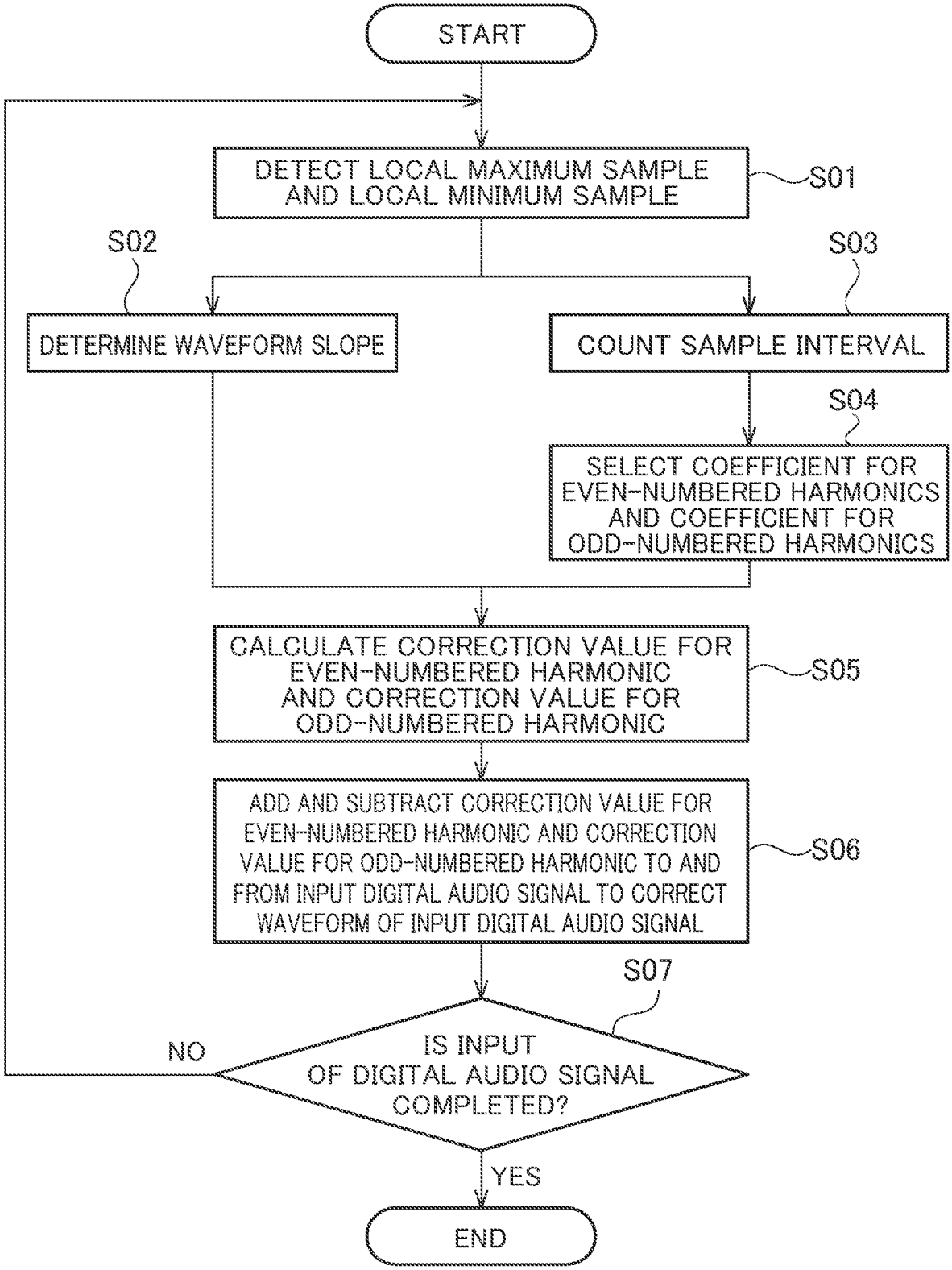
FIG. 10 is a flowchart illustrating a process performed by a digital audio processing device according to one or more embodiments, a process of a digital audio processing method according to one or more embodiments, and a process that a digital audio processing program according to one or more embodiments causes a computer to perform.

With reference to a flowchart shown in FIG. 10, a digital audio processing method which is a process performed by the digital audio processing device 100 will be described. In FIG. 10, after a digital audio signal is input to the digital audio processing device 100, the process is started. In the process, the local maximum sample detector 11 and the local minimum sample detector 12 detect the local maximum sample and the local minimum sample in step S01. In step S02, the waveform slope determiner 13 determines whether a sample constituting a digital audio signal is a waveform part in which a sample value increases from a local minimum sample to a local maximum sample or a waveform part in which a sample value decreases from a local maximum sample to a local minimum sample.

In parallel with step S02, in step S03, the counter 14 counts a sample interval between a local minimum sample and a local maximum sample that are adjacent to each other in the time direction. In step S04, the coefficient selector 15 selects coefficients for even-numbered harmonics and coefficients for odd-numbered harmonics according to the sample interval counted by the counter 14.

In step S05, the even-numbered harmonic adder 171 and the odd-numbered harmonic adder 172 calculate correction values Vadd and Vsub which are correction values for even-numbered harmonics, and calculate correction values Vadd and Vsub which are correction values for odd-numbered harmonics. In step S06, the even-numbered harmonic adder 171 and the odd-numbered harmonic adder 172 add and subtract a correction value for even-numbered harmonic and a correction value for odd-numbered harmonic to and from a digital audio signal. Accordingly, a waveform of a digital audio signal is corrected.

In step S07, the digital audio processing device 100 determines whether the input of a digital audio signal has been completed. If the input of a digital audio signal has not been completed (NO), the digital audio processing device 100 repeats the processes from steps S01 to S07. Alternatively, if the input of a digital audio signal has been completed (YES), the digital audio processing device 100 ends the process.

In the first even-numbered harmonic addition process shown in FIG. 4 in which a sample interval is 3 fs, the correction value Vadd is added to the sample S1 among the samples S1 and S2 which are adjacent to each other, and the correction value Vsub is subtracted from the sample S2. Therefore, depending on the relationship between the magnitude of the correction value Vadd and the magnitude of the correction value Vsub, a reverse phenomenon may occur in which the magnitude relationship between the sample S1' and the sample S2' is reversed. Similarly, in the second even-numbered harmonic addition process shown in FIG. 5, a reverse phenomenon may occur in which the magnitude relationship between the sample S4' and the sample S5' is reversed.

Figure 11A:
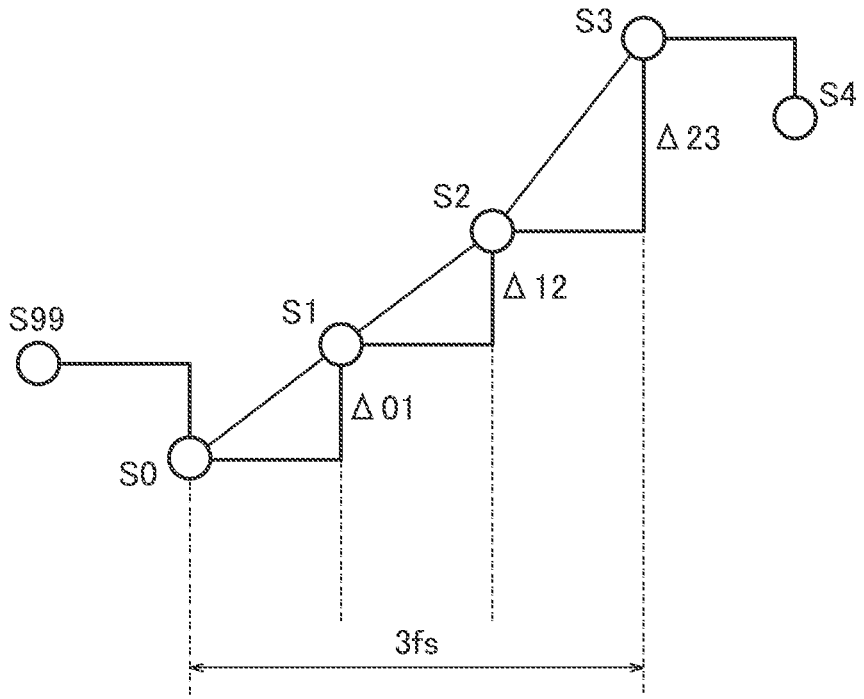
FIG. 11A is a waveform diagram illustrating an example of a waveform having a sample interval of 3 fs in which a reverse phenomenon occurs due to correction of a digital audio signal.
Figure 11B:
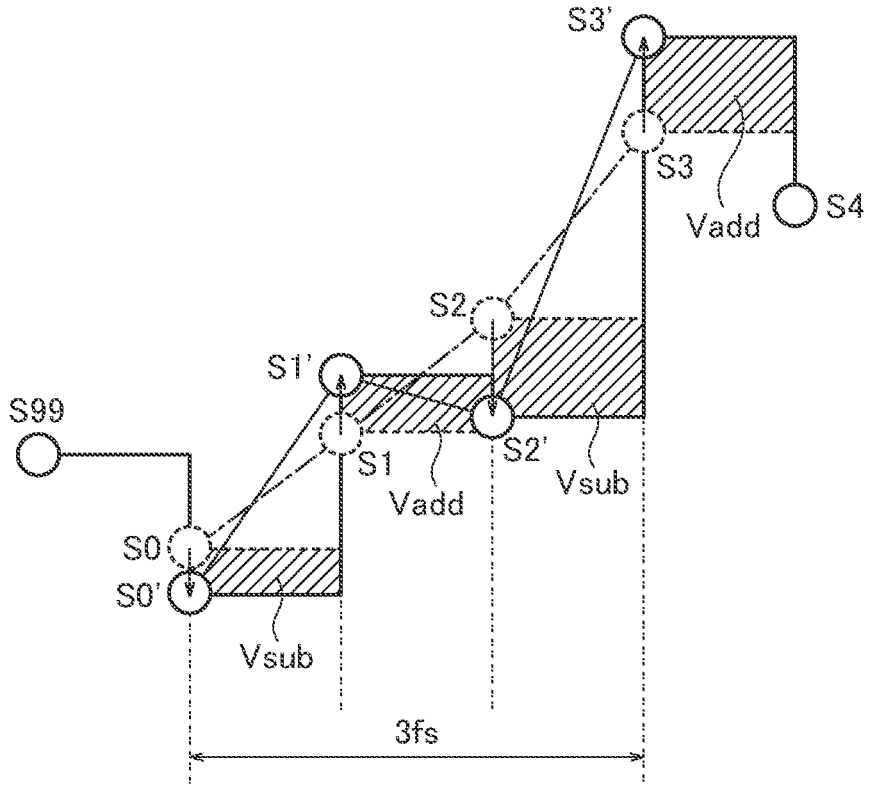
FIG. 11B is a waveform diagram illustrating a state in which a reverse phenomenon occurs due to correction of a waveform having a sample interval of 3 fs shown in FIG. 11A.

With reference to FIGS. 11A and 11B, a case where the magnitude relationship between the sample S1' and the sample S2' is reversed will be described by taking the first even-numbered harmonic addition process as an example. In FIG. 11A, a difference value between the local minimum sample S0 and the sample S1 is set to Δ01. A difference value between the sample S1 and the sample S2 is set to Δ12, and a difference value between the sample S2 and the local maximum sample S3 is set to Δ23. The difference value Δ23 is remarkably larger than the difference values Δ01 and Δ12.

In such a case, as shown in FIG. 11B, the correction value Vsub subtracted from the sample S2 is remarkably larger than the correction value Vadd added to the sample S1. FIG. 11B shows a case where a coefficient is ½. Accordingly, a waveform in which a sample value increases from the sample S1 to the sample S2 becomes a waveform in which a sample value decreases from the sample S1' to the sample S2'. Such a reverse phenomenon of the sample values of the samples S1' and S2' deteriorates an original waveform before correction. Therefore, it is desirable to avoid the occurrence of a reverse phenomenon.

Figure 12A:
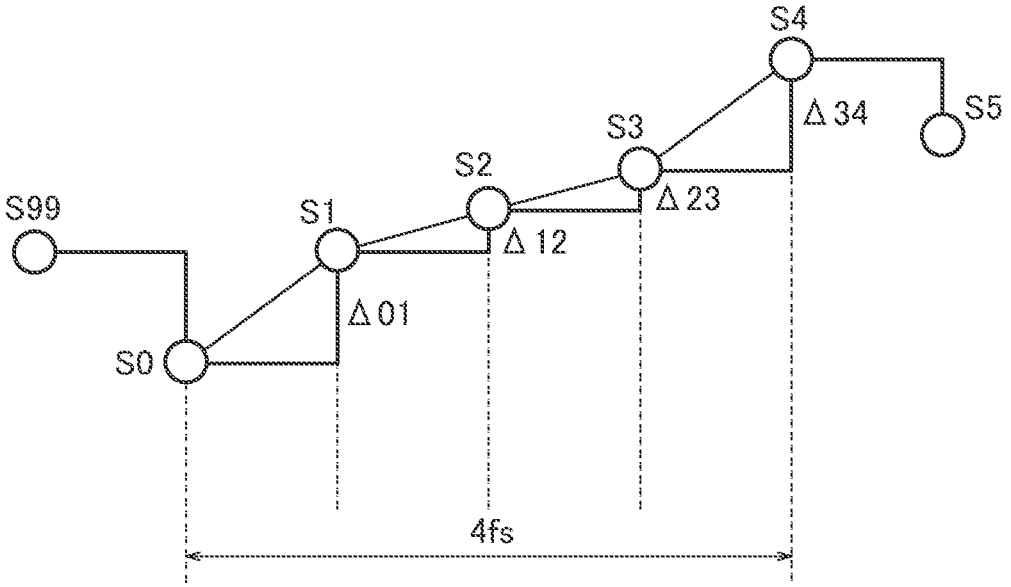
FIG. 12A is a waveform diagram illustrating an example of a waveform having a sample interval of 4 fs in which a reverse phenomenon occurs due to correction of a digital audio signal.

A reverse phenomenon may also occur, if a sample interval is 4 fs or more. In FIG. 12A, a difference value between the local minimum sample S0 and the sample S1 is set to Δ01. A difference value between the sample S1 and the sample S2 is set to Δ12, a difference value between the sample S2 and the sample S3 is set to Δ23, and a difference value between the sample S3 and the local maximum sample S4 is set to Δ34. The difference value Δ01 is remarkably larger than the difference value Δ12, and the difference value Δ34 is remarkably larger than the difference value Δ23.

Figure 12B:
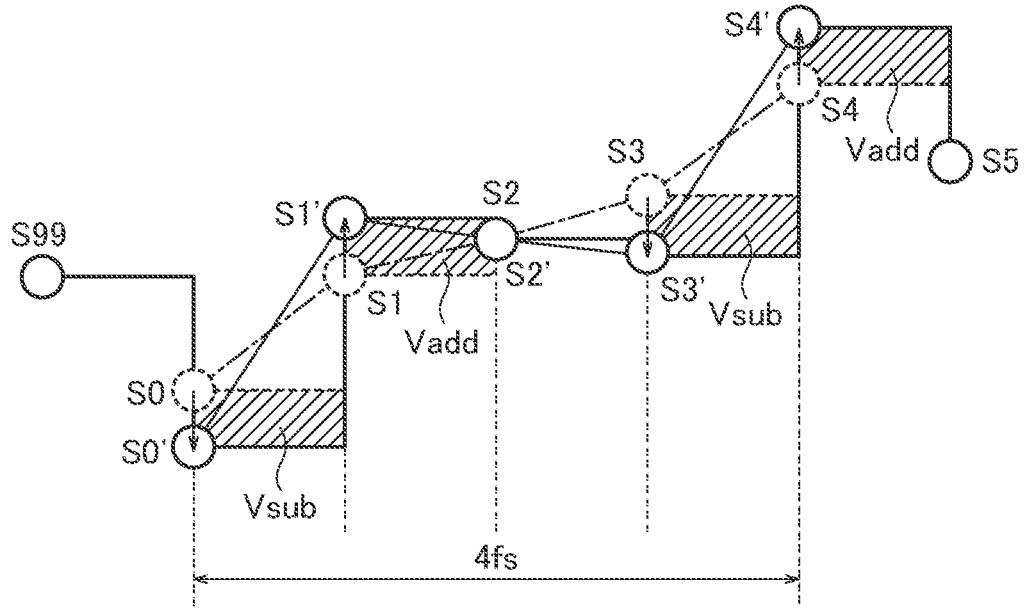
FIG. 12B is a waveform diagram illustrating a state in which a reverse phenomenon occurs due to correction of a waveform having a sample interval of 4 fs shown in FIG. 12A.

In such a case, as shown in FIG. 12B, a reverse phenomenon may occur in which the correction value Vadd added to the sample S1 is larger than the difference value Δ12, and the sample value of the sample S1' is larger than the sample value of the sample S2. Further, a reverse phenomenon may occur in which the correction value Vsub subtracted from the sample S3 is larger than the difference value Δ23, and the sample value of the sample S3' is smaller than the sample value of the sample S2. FIG. 12B shows a case where a coefficient is ½.

If a sample interval is 4 fs or more, it is desirable to avoid the occurrence of a reverse phenomenon in which a sample value of a correction sample to which the correction value Vadd is added becomes larger than a sample value of the next sample after the correction sample. Further, it is desirable to avoid the occurrence of a reverse phenomenon in which a sample value of a correction sample from which the correction value Vsub is subtracted becomes smaller than a sample value of a sample that is one sample before the correction sample.

Therefore, if a sample interval is 3 fs, and the first adjacent sample and the second adjacent sample are adjacent to each other, the even-numbered harmonic adder 171 may perform the first even-numbered harmonic addition process as follows. The even-numbered harmonic adder 171 limits a first correction value and a second correction value such that the magnitude relationship of sample values between a first correction sample and a second correction sample is not reversed, the first correction sample being obtained by adding the first correction value to the first adjacent sample, and the second correction sample being obtained by subtracting the second correction value from the second adjacent sample.

In addition, it is preferable that the even-numbered harmonic adder 171 performs the second even-numbered harmonic addition process as follows. The even-numbered harmonic adder 171 limits a third correction value and a fourth correction value such that the magnitude relationship of sample values between a third correction sample and a fourth correction sample is not reversed, the third correction sample being obtained by subtracting the third correction value from the third adjacent sample, and the fourth correction sample being obtained by adding the fourth correction value to the fourth adjacent sample.

Figure 13:
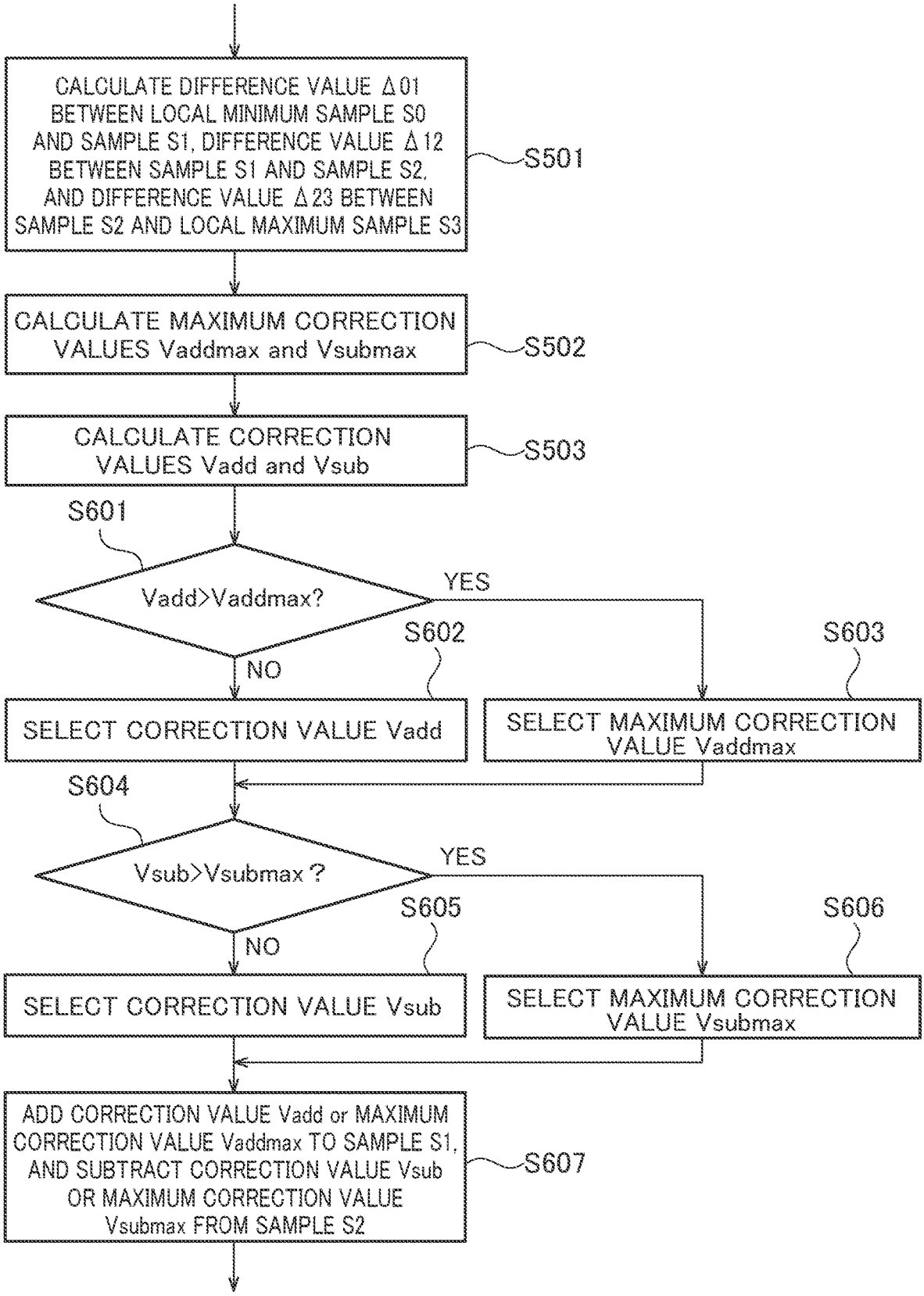
FIG. 13 is a flowchart illustrating a first example of a process for avoiding a reverse phenomenon in a case of a waveform having a sample interval of 3 fs.

Specifically, in order to avoid the occurrence of a reverse phenomenon when a sample interval is 3 fs, the digital audio processing device 100 may perform steps S05 and S06 of FIG. 10 so as to include the process shown in FIG. 13. FIG. 13 is a first example of a process for avoiding a reverse phenomenon in a case of a waveform in which a sample interval is 3 fs, and the first even-numbered harmonic addition process is taken as an example. The same applies to the process when the occurrence of a reverse phenomenon is avoided in the second even-numbered harmonic addition process.

In step S501, the even-numbered harmonic adder 171 calculates a difference value Δ01 between the local minimum sample S0 and the sample S1, a difference value Δ12 between the sample S1 and the sample S2, and a difference value Δ23 between the sample S2 and the local maximum sample S3. The even-numbered harmonic adder 171 calculates maximum correction values Vaddmax and Vsubmax in step S502. The even-numbered harmonic adder 171 calculates the correction values Vadd and Vsub in step S503. The order of steps S502 and S503 may be reversed. As a first example, the maximum correction values Vaddmax and Vsubmax are ½ of the difference value Δ12. The maximum correction values Vaddmax and Vsubmax may be less than ½ of the difference value Δ12.

In step S601, the even-numbered harmonic adder 171 determines whether the correction value Vadd exceeds the maximum correction value Vaddmax. If the correction value Vadd does not exceed the maximum correction value Vaddmax (NO), the even-numbered harmonic adder 171 selects the correction value Vadd in step S602, and the process proceeds to step S604. Alternatively, if the correction value Vadd exceeds the maximum correction value Vaddmax (YES), the even-numbered harmonic adder 171 selects the maximum correction value Vaddmax in step S603, and the process proceeds to step S604.

In step S604, the even-numbered harmonic adder 171 determines whether the correction value Vsub exceeds the maximum correction value Vsubmax. If the correction value Vsub does not exceed the maximum correction value Vsubmax (NO), the even-numbered harmonic adder 171 selects the correction value Vsub in step S605, and the process proceeds to step S607. Alternatively, if the correction value Vsub exceeds the maximum correction value Vsubmax (YES), the even-numbered harmonic adder 171 selects the maximum correction value Vsubmax in step S606, and the process proceeds to step S607.

In step S607, the even-numbered harmonic adder 171 adds the correction value Vadd or the maximum correction value Vaddmax to the sample S1. The even-numbered harmonic adder 171 subtracts the correction value Vsub or the maximum correction value Vsubmax from the sample S2.

If performed as above, the correction values Vadd and Vsub do not exceed a median value between the samples S1 and S2. This avoids the occurrence of a reverse phenomenon.

As a second example, the maximum correction values Vaddmax and Vsubmax may be set to a value obtained by dividing the difference value Δ12 by the ratio between the difference value Δ01 and the difference value Δ23. The maximum correction value Vaddmax is calculated by (Δ01×Δ12)/(Δ01+Δ23). The maximum correction value Vsubmax is calculated by (Δ23×Δ12)/(Δ01+Δ23). If performed as above, the correction values Vadd and Vsub do not exceed a value obtained by dividing the difference value Δ12 by the ratio between the difference value Δ01 and the difference value Δ23. This can avoid the occurrence of a reverse phenomenon.

In FIG. 13, for example, if the correction value Vadd is small and the correction value Vsub is large, the sum of the correction value Vadd and the correction value Vsub may not exceed the difference value Δ12. In this case, a reverse phenomenon does not actually occur. Regardless of whether a reverse phenomenon actually occurs, if the correction value Vadd exceeds the maximum correction value Vaddmax, the correction value Vadd is limited to the maximum correction value Vaddmax. If the correction value Vsub exceeds the maximum correction value Vsubmax, the correction value Vsub is limited to the maximum correction value Vsubmax.

Figure 14:
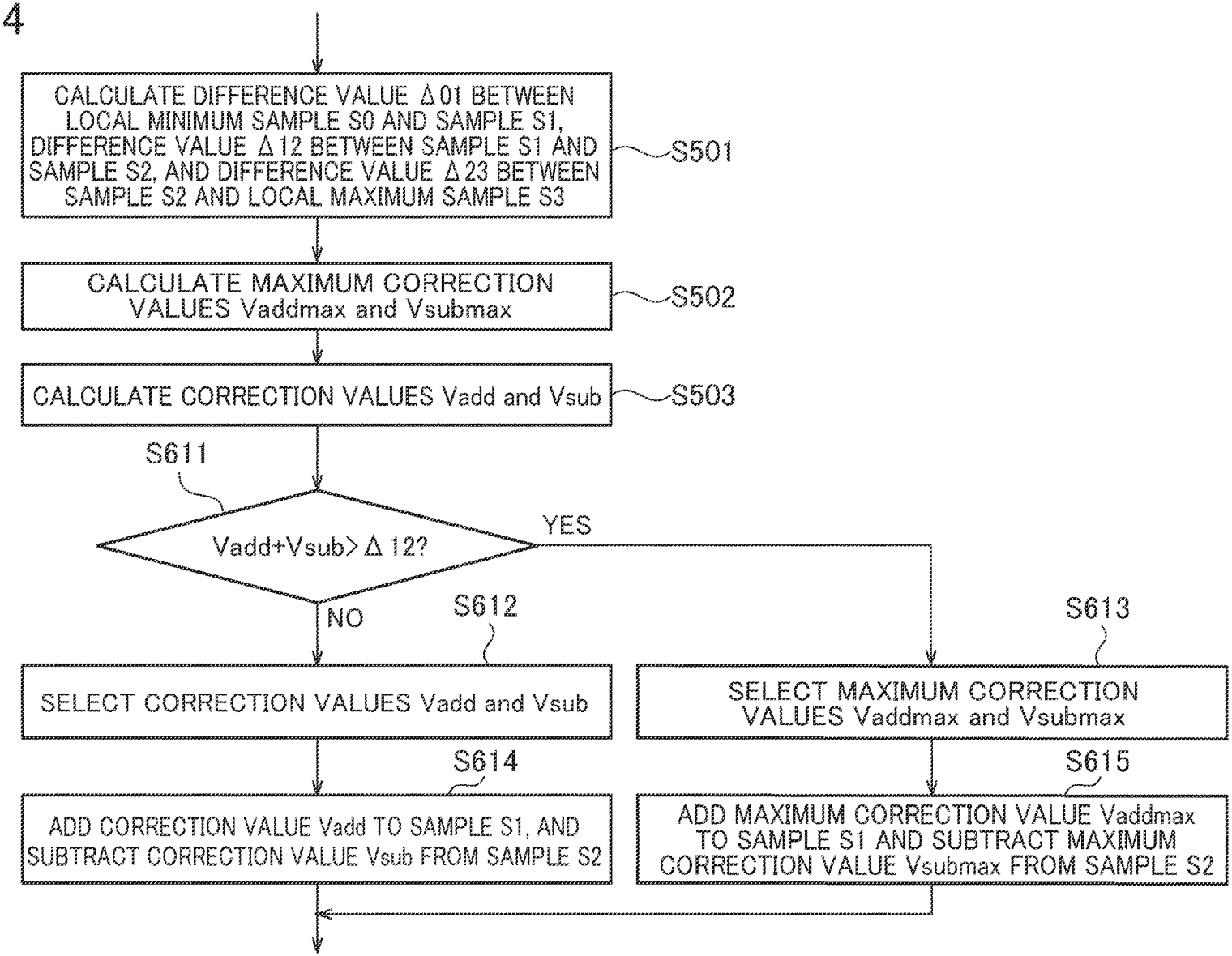
FIG. 14 is a flowchart illustrating a second example of a process for avoiding a reverse phenomenon in a case of a waveform having a sample interval of 3 fs.

In order to avoid the occurrence of a reverse phenomenon when a sample interval is 3 fs, the digital audio processing device 100 may perform steps S05 and S06 of FIG. 10 so as to include the process shown in FIG. 14 instead of the process shown in FIG. 13. FIG. 14 is a second example of a process for avoiding a reverse phenomenon in a case of a waveform in which a sample interval is 3 fs, and the first even-numbered harmonic addition process is taken as an example. The same applies to the process when the occurrence of a reverse phenomenon is avoided in the second even-numbered harmonic addition process.

Steps S501 to S503 in FIG. 14 are the same as steps S501 to S503 in FIG. 13. In FIG. 14 also, maximum correction values Vaddmax and Vsubmax may be ½ of the difference value Δ12, or a value obtained by dividing the difference value Δ12 by the ratio between the difference value Δ01 and the difference value Δ23.

In step S611 of FIG. 14, the even-numbered harmonic adder 171 determines whether the sum of the correction value Vadd and the correction value Vsub exceeds the difference value Δ12. Information that the sum exceeds the difference value Δ12 means that a reverse phenomenon occurs. If the sum does not exceed the difference value Δ12 (NO), the even-numbered harmonic adder 171 selects the correction values Vadd and Vsub in step S612. Subsequently, in step S614, the even-numbered harmonic adder 171 adds the correction value Vadd to the sample S1, and subtracts the correction value Vsub from the sample S2.

If the sum exceeds the difference value Δ12 (YES) in step S611, the even-numbered harmonic adder 171 selects the maximum correction values Vaddmax and Vsubmax in step S613. Subsequently, in step S615, the even-numbered harmonic adder 171 adds the maximum correction value Vaddmax to the sample S1 and subtracts the maximum correction value Vsubmax from the sample S2.

In FIG. 14, suppose that the sum of the correction value Vadd and the correction value Vsub exceeds the difference value Δ12, and a reverse phenomenon actually occurs. In the above case, the correction value Vadd is limited to the maximum correction value Vaddmax, and the correction value Vsub is limited to the maximum correction value Vsubmax.

Figure 15A:
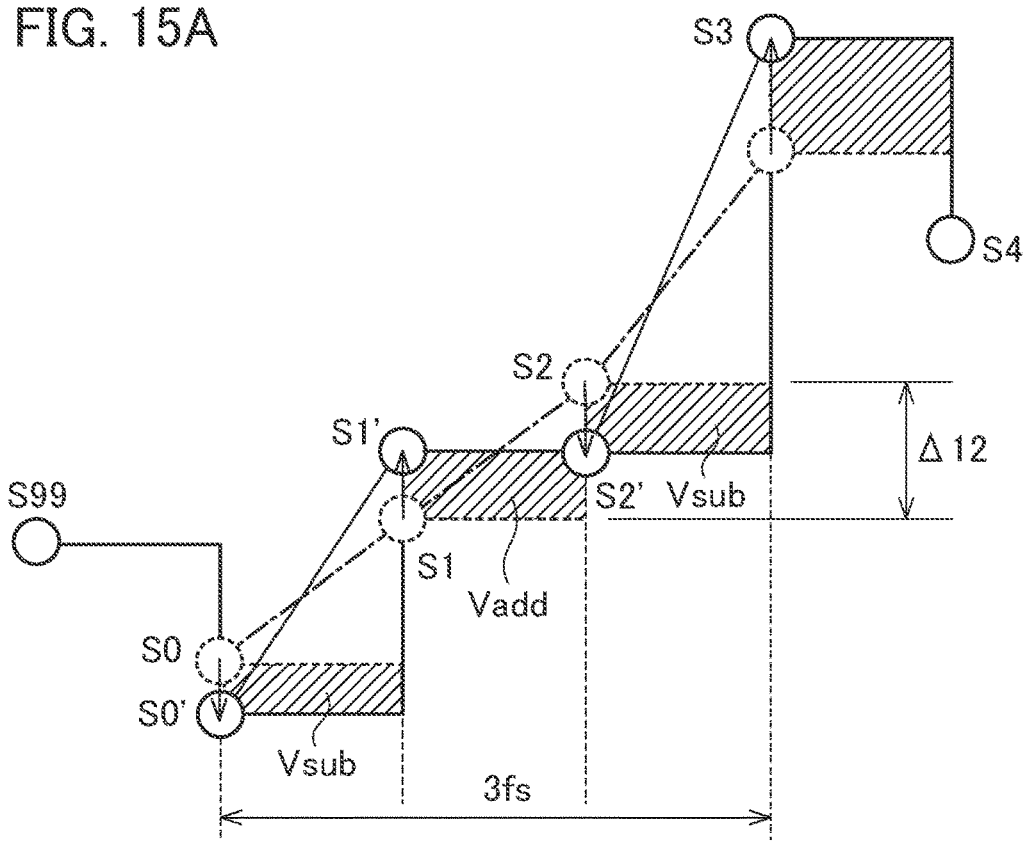
FIG. 15A is a waveform diagram illustrating a first example of a state in which a reverse phenomenon is avoided by the process shown in FIG. 13 or 14.
Figure 15B:
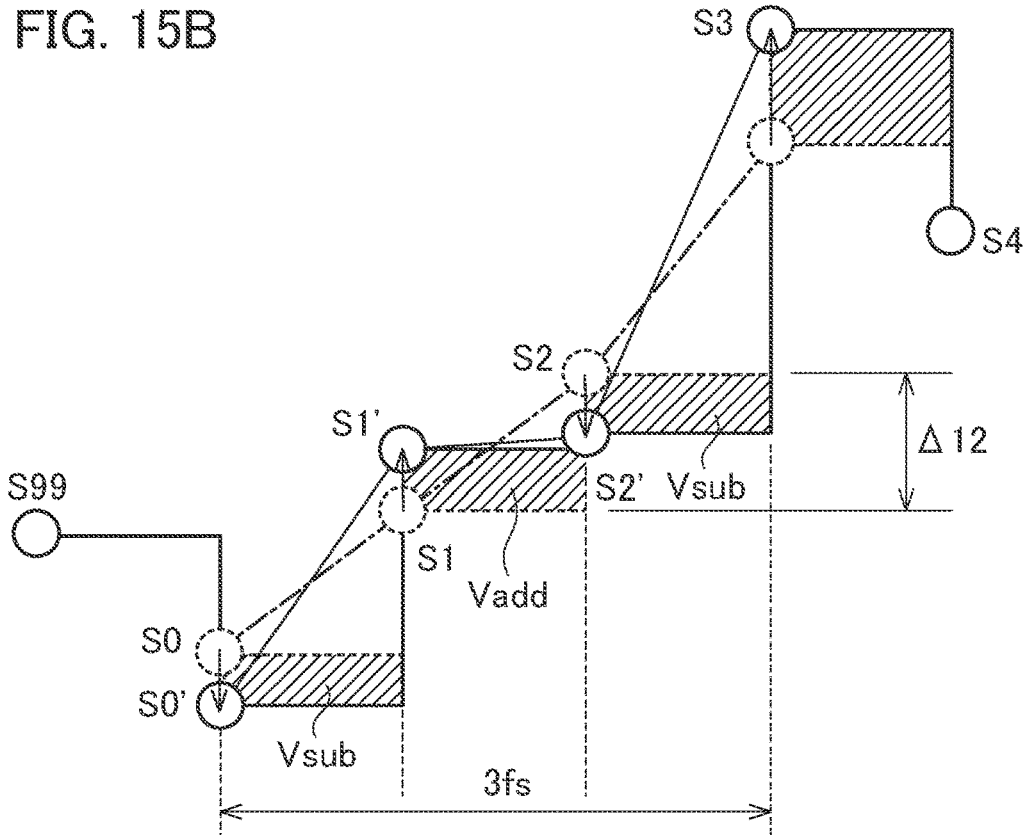
FIG. 15B is a waveform diagram illustrating a second example of a state in which a reverse phenomenon is avoided by the process shown in FIG. 13 or 14.

FIG. 15A shows a case where the occurrence of a reverse phenomenon is avoided by the process shown in FIG. 13 or FIG. 14. A waveform before correction shown in FIG. 15A is the same as the waveform of FIG. 11A. FIG. 15A shows a case where the maximum correction values Vaddmax and Vsubmax are ½ of the difference value Δ12. In this case, the samples S1' and S2' take the same value, and therefore a waveform becomes flat. FIG. 15B shows a case where the maximum correction values Vaddmax and Vsubmax are less than ½ of the difference value Δ12. In this case, a value of the sample S1' is smaller than a value of the sample S2', and therefore a sloped waveform is maintained.

As described above, if the even-numbered harmonic adder 171 performs the first even-numbered harmonic addition process under a condition that a first sample interval is 3 fs, and the first adjacent sample and the second adjacent sample are adjacent to each other, the occurrence of a reverse phenomenon may be avoided as follows. The even-numbered harmonic adder 171 limits a first correction value and a second correction value such that the magnitude relationship of sample values between a first correction sample and a second correction sample is not reversed, the first correction sample being obtained by adding the first correction value to the first adjacent sample, and the second correction sample being obtained by subtracting the second correction value from the second adjacent sample.

If the even-numbered harmonic adder 171 performs the second even-numbered harmonic addition process under a condition that a second sample interval is 3 fs, and the third adjacent sample and the fourth adjacent sample are adjacent to each other, the occurrence of a reverse phenomenon may be avoided as follows. The even-numbered harmonic adder 171 limits a third correction value and a fourth correction value such that magnitude relationship of sample values between a third correction sample and a fourth correction sample is not reversed, the third correction sample being obtained by subtracting the third correction value from the third adjacent sample, and the fourth correction sample being obtained by adding the fourth correction value to the fourth adjacent sample.

Figure 16:
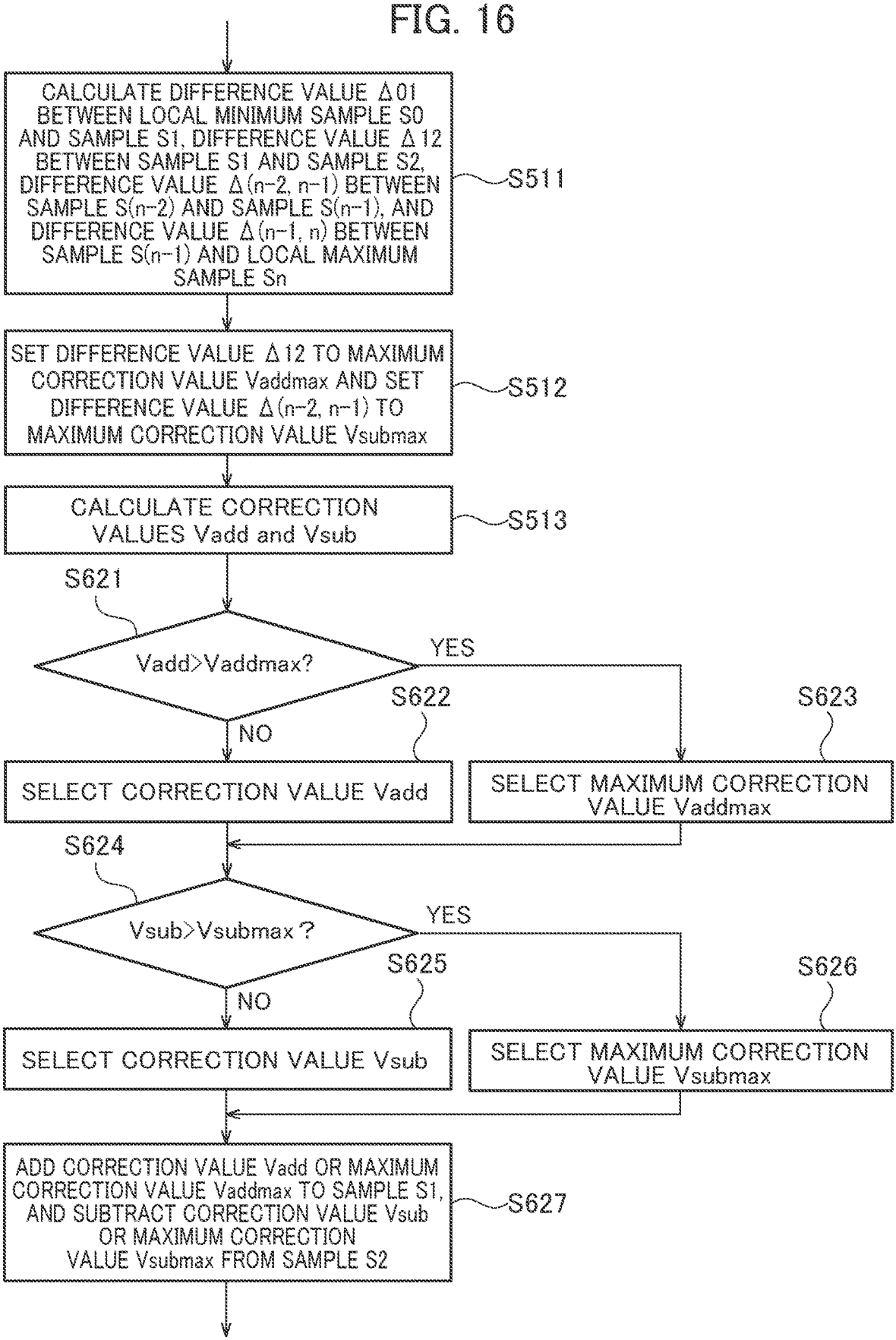
FIG. 16 is a flowchart illustrating a process for avoiding a reverse phenomenon in a case of a waveform having a sample interval of 4 fs or more.

In order to avoid the occurrence of a reverse phenomenon when a sample interval is 4 fs or more, the digital audio processing device 100 may perform steps S05 and S06 in FIG. 10 so as to include the process shown in FIG. 16. FIG. 16 shows a case where the even-numbered harmonic adder 171 adds the correction value Vadd to or subtracts the correction value Vsub from only two samples across a local minimum sample and two samples across a local maximum sample. FIG. shows an example of the first even-numbered harmonic addition process. The same applies to the process when the occurrence of a reverse phenomenon is avoided in the second even-numbered harmonic addition process.

A local maximum sample is set to Sn, a sample that immediately precedes the local maximum sample Sn is set to S(n−1), and a sample that precedes the local maximum sample Sn by one sample is set to S(n−2). A difference value between the sample S(n−2) and the sample S(n−1) is set to Δ(n−2, n−1), and a difference value between the sample S(n−1) and the local maximum sample Sn is set to Δ(n−1, n).

In step S511 of FIG. 16, the even-numbered harmonic adder 171 calculates a difference value Δ01 between the local minimum sample S0 and the sample S1, a difference value Δ12 between the sample S1 and the sample S2, a difference value Δ(n−2, n−1) between the sample S(n−2) and the sample S(n−1), and a difference value Δ(n−1, n) between the sample S(n−1) and the local maximum sample Sn.

In step S512, the even-numbered harmonic adder 171 sets the difference value Δ12 to the maximum correction value Vaddmax and sets the difference value Δ(n−2, n−1) to the maximum correction value Vsubmax. In step S513, the even-numbered harmonic adder 171 calculates the correction values Vadd and Vsub. The order of steps S512 and S513 may be reversed. A value smaller than the difference value Δ12 which is obtained by multiplying the difference value Δ12 by a value less than 1 may be set to the maximum correction value Vaddmax. A value smaller than the difference value Δ(n−2, n−1) which is obtained by multiplying the difference value Δ(n−2, n−1) by a value less than 1 may be set to the maximum correction value Vsubmax.

In step S621, the even-numbered harmonic adder 171 determines whether the correction value Vadd exceeds the maximum correction value Vaddmax. If the correction value Vadd does not exceed the maximum correction value Vaddmax (NO), the even-numbered harmonic adder 171 selects the correction value Vadd in step S622, and the process proceeds to step S624. Alternatively, if the correction value Vadd exceeds the maximum correction value Vaddmax (YES), the even-numbered harmonic adder 171 selects the maximum correction value Vaddmax in step S623, and the process proceeds to step S624.

In step S624, the even-numbered harmonic adder 171 determines whether the correction value Vsub exceeds the maximum correction value Vsubmax. If the correction value Vsub does not exceed the maximum correction value Vsubmax (NO), the even-numbered harmonic adder 171 selects the correction value Vsub in step S625, and the process proceeds to step S627. Alternatively, if the correction value Vsub exceeds the maximum correction value Vsubmax (YES), the even-numbered harmonic adder 171 selects the maximum correction value Vsubmax in step S626, and the process proceeds to step S627.

In step S627, the even-numbered harmonic adder 171 adds the correction value Vadd or the maximum correction value Vaddmax to the sample S1, and subtracts the correction value Vsub or the maximum correction value Vsubmax from the sample S2.

Figure 17A:
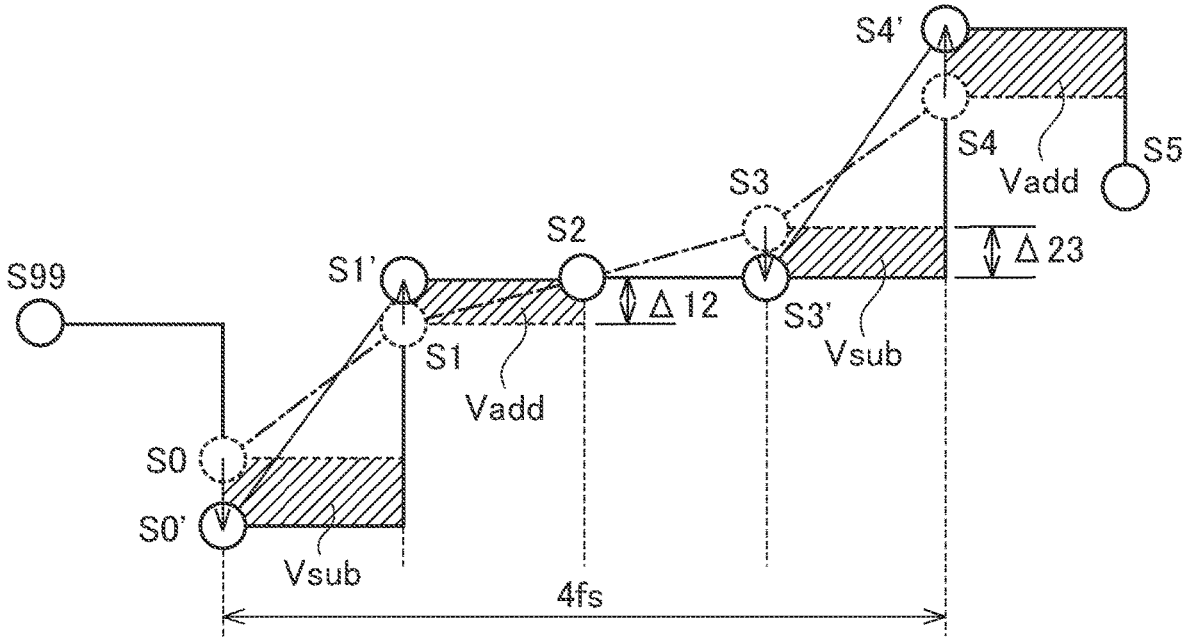
FIG. 17A is a waveform diagram illustrating a first example of a state in which a reverse phenomenon is avoided by the process shown in FIG. 16.
Figure 17B:
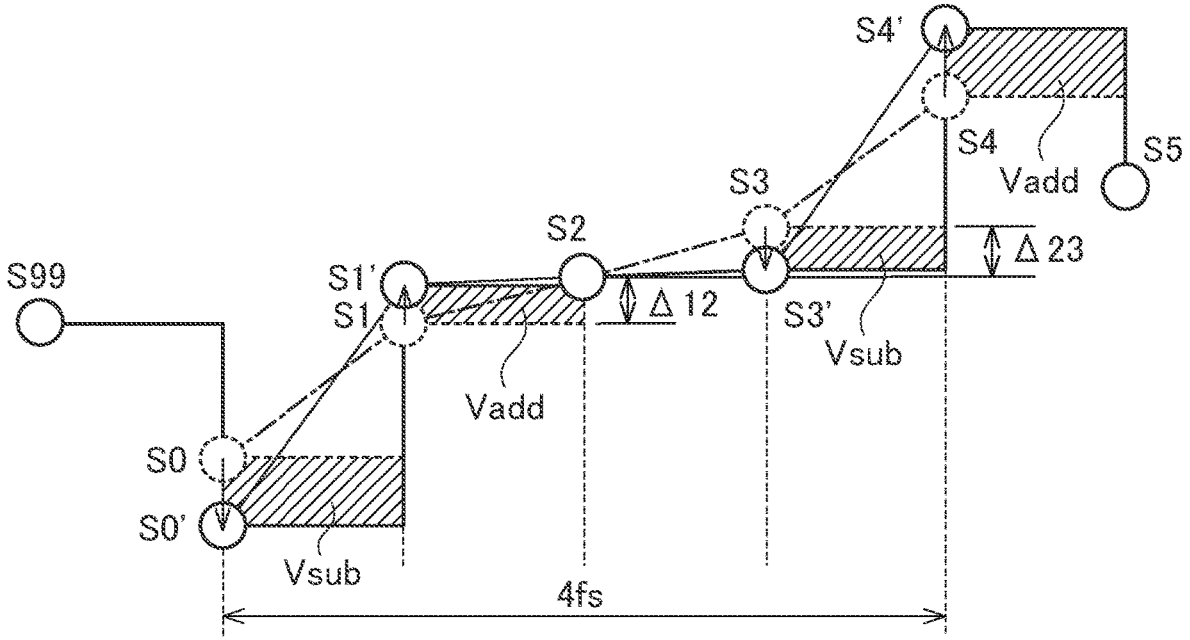
FIG. 17B is a waveform diagram illustrating a second example of a state in which a reverse phenomenon is avoided by the process shown in FIG. 16.

By the process shown in FIG. 16, as shown in FIG. 17A or FIG. 17B, the occurrence of a reverse phenomenon in which a sample value of the sample S1' becomes larger than a sample value of the sample S2 is avoided. Further, the occurrence of a reverse phenomenon in which a sample value of the sample S3' becomes smaller than a sample value of the sample S2 is avoided. FIGS. 17A and 17B show a case where a sample interval is 4 fs.

FIG. 17A shows a case where the difference value Δ12 is set to the maximum correction value Vaddmax, and the difference value Δ23 is set to the maximum correction value Vsubmax. In this case, the sample S1', the sample S2, and the sample S3' take the same value, and a waveform becomes flat. FIG. 17B shows a case where a value smaller than the difference value Δ12 is set to the maximum correction value Vaddmax, and a value smaller than the difference value Δ23 is set to the maximum correction value Vsubmax. In this case, a value of the sample S1' is smaller than a value of the sample S2, and a value of the sample S3' is larger than a value of the sample S2, and therefore a sloped waveform is maintained.

As described above, if the even-numbered harmonic adder 171 performs the first even-numbered harmonic addition process under a condition that a first sample interval is 4 fs or more, the occurrence of a reverse phenomenon may be avoided as follows. The even-numbered harmonic adder 171 limits a first correction value such that a sample value of the first correction sample is not larger than a sample value of a next sample that follows the first adjacent sample. Further, the even-numbered harmonic adder 171 limits a second correction value such that a sample value of the second correction sample is not smaller than a sample value of a sample that is one sample before the second adjacent sample.

If the even-numbered harmonic adder 171 performs the second even-numbered harmonic addition process under a condition that a second sample interval is 4 fs or more, the occurrence of a reverse phenomenon may be avoided as follows. The even-numbered harmonic adder 171 limits a third correction value such that a sample value of the third correction sample is not smaller than a sample value of a next sample that follows the third adjacent sample. Further, the even-numbered harmonic adder 171 limits a fourth correction value such that a sample value of the fourth correction sample is not larger than a sample value of a sample that is one sample before the fourth adjacent sample.

Suppose that the even-numbered harmonic adder 171 adds the correction value Vadd to or subtracts the correction value Vsub from 4 samples of 2 samples before and after the local minimum sample, and 4 samples of 2 samples before and after the local maximum sample as shown in FIG. 6 or FIG. 7. In the above case, the even-numbered harmonic adder 171 may avoid the occurrence of a reverse phenomenon as follows.

In FIG. 6, the even-numbered harmonic adder 171 limits a first correction value such that a sample value of the correction sample S1' is not larger than a sample value of the next correction sample S2'. The even-numbered harmonic adder 171 limits a second correction value such that a sample value of the correction sample S5' is not smaller than a sample value of the correction sample S4' that is one sample before the correction sample S5'. In FIG. 7, the even-numbered harmonic adder 171 limits a third correction value such that a sample value of the correction sample S7' is not smaller than a sample value of the next correction sample S8'. The even-numbered harmonic adder 171 limits a fourth correction value such that a sample value of the correction sample S11' is not larger than a sample value of the correction sample S10' that is one sample before the correction sample S11'.

If the number of samples to be corrected is further increased, the even-numbered harmonic adder 171 may similarly limit a correction value such that a sample value of each sample to be corrected is not larger or smaller than a sample value of a correction sample adjacent to each sample to be corrected.

Figure 18:
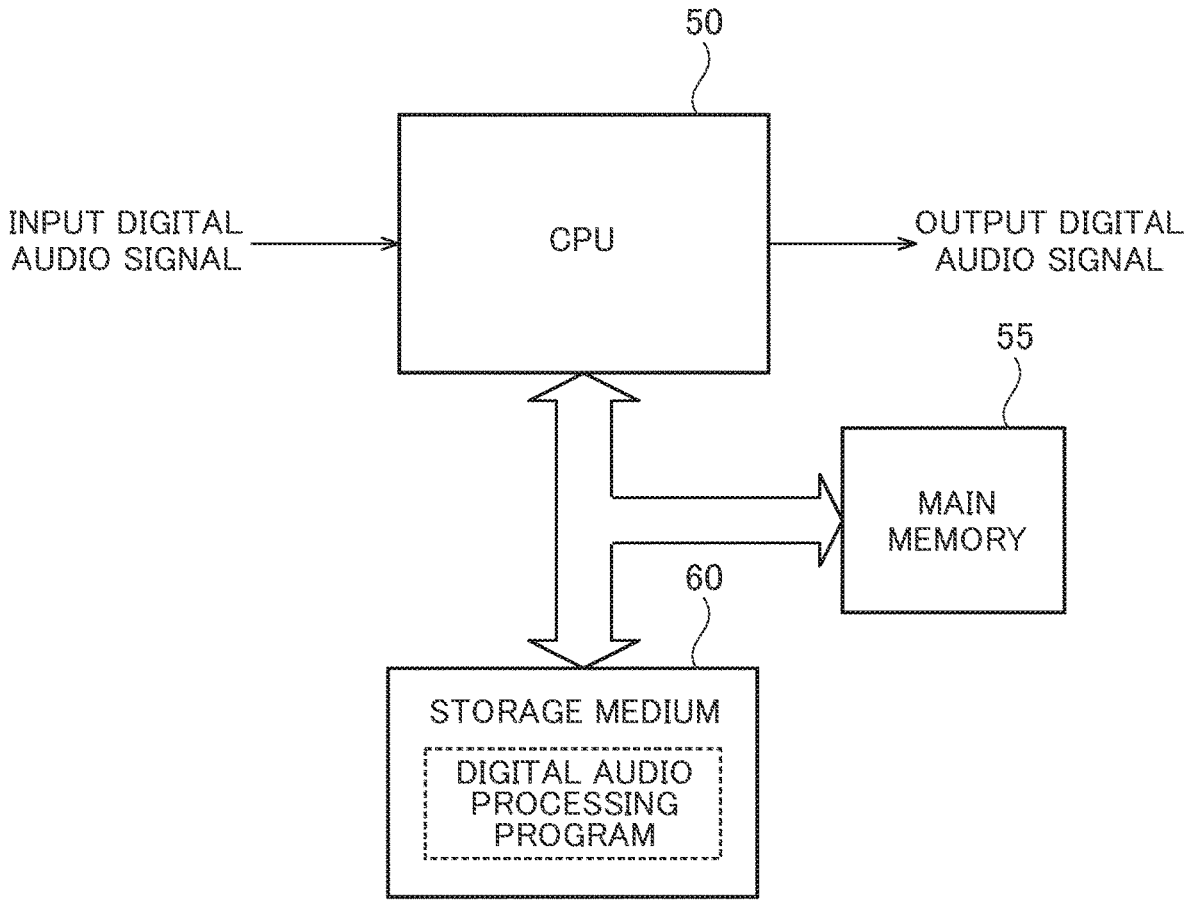
FIG. 18 is a block diagram illustrating a configuration example of a microcomputer for executing a digital audio processing program according to one or more embodiments.

The digital audio processing device 100 shown in FIG. 1 can be realized by a central processing unit (CPU) of a microcomputer executing a digital audio processing program. In FIG. 18, a CPU 50, a main memory 55, and a storage medium 60 are connected via a bus. The storage medium 60 is any non-transitory storage medium, such as a hard disk drive, an optical disc, or a semiconductor memory. The digital audio processing program is stored in the storage medium 60. The digital audio processing program may be transmitted from an external server through a communication line such as the Internet to be stored in the storage medium 60.

The CPU 50 loads the digital audio processing program stored in the storage medium 60 into the main memory 55. The CPU 50 executes each instruction described in the digital audio processing program loaded into the main memory 55 to perform the process shown in FIG. 10. The CPU 50 performs either one of a first even-numbered harmonic addition step corresponding to the first even-numbered harmonic addition process described above and a second even-numbered harmonic addition step corresponding to the second even-numbered harmonic addition process, and an odd-numbered harmonic addition step corresponding to the odd-numbered harmonic addition process described above.

If a sample interval is 3 fs, in order to avoid the occurrence of a reverse phenomenon, the CPU 50 preferably performs steps of limiting a first correction value and a second correction value or steps of limiting a third correction value and a fourth correction value corresponding to the process shown in FIG. 13 or 14. If a sample interval is 4 fs or more, the CPU 50 preferably performs steps of limiting a first correction value and a second correction value, or steps of limiting a third correction value and a fourth correction value corresponding to the process shown in FIG. 16.

As described above, in accordance with a digital audio processing device, a digital audio processing method, and a digital audio processing program according to one or more embodiments, it is possible to correct both a waveform part in which a sample value increases and a waveform part in which a sample value decreases, and both an even-numbered to harmonic and an odd-numbered harmonic can be added to a digital audio signal.

The present invention is not limited to one or more embodiments described above, and various modifications are possible without departing from the scope of the present invention.

What is claimed is:

1. A digital audio processing device comprising:

a local maximum sample detector configured to calculate a local maximum in a sample constituting an input digital audio signal and detect a local maximum sample including the local maximum;

a local minimum sample detector configured to calculate a local minimum in the sample constituting the digital audio signal and detect a local minimum sample including the local minimum;

a waveform slope determiner configured to determine whether the sample constituting the digital audio signal is a waveform part in which a sample value increases from the local minimum sample to the local maximum sample, or a waveform part in which the sample value decreases from the local maximum sample to the local minimum sample;

a counter configured to count a sample interval between the local minimum sample and the local maximum sample that are adjacent to each other in a time direction;

a coefficient selector configured to select a coefficient for even-numbered harmonics and a coefficient for odd-numbered harmonics according to the sample interval counted by the counter; and a harmonic component adder that comprises an even-numbered harmonic adder configured to add an even-numbered harmonic to the digital audio signal, and an odd-numbered harmonic adder configured to add an odd-numbered harmonic to the digital audio signal, the harmonic component adder being configured to add a harmonic component including the even-numbered harmonic and the odd-numbered harmonic to the digital audio signal and output the digital audio signal, wherein if the sample constituting the digital audio signal increases from a first local minimum sample to a first local maximum sample and decreases from the first local maximum sample to a second local minimum sample, the even-numbered harmonic adder performs either one of a first even-numbered harmonic addition process for adding the even-numbered harmonic to the digital audio signal, and a second even-numbered harmonic addition process for adding the even-numbered harmonic to the digital audio signal, the first even-numbered harmonic addition process being performed by, adding, to a first adjacent sample that is a next sample that follows the first local minimum sample, a first correction value obtained by multiplying a first difference value between the first local minimum sample and the first adjacent sample by a first coefficient for even-numbered harmonics that is selected by the coefficient selector according to a first sample interval between the first local minimum sample and the first local maximum sample, subtracting, from a second adjacent sample that is one sample before the first local maximum sample, a second correction value obtained by multiplying a second difference value between the second adjacent sample and the first local maximum sample by the first coefficient for even-numbered harmonics, adding, to a third adjacent sample that is a next sample that follows the first local maximum sample, a third correction value obtained by multiplying a third difference value between the first local maximum sample and the third adjacent sample by a second coefficient for even-numbered harmonics selected by the coefficient selector according to a second sample interval between the first local maximum sample and the second local minimum sample, and subtracting, from a fourth adjacent sample that is one sample before the second local minimum sample, a fourth correction value obtained by multiplying a fourth difference value between the fourth adjacent sample and the second local minimum sample by the second coefficient for even-numbered harmonics, and the second even-numbered harmonic addition process being performed by subtracting the first correction value from the first adjacent sample, adding the second correction value to the second adjacent sample, subtracting the third correction value from the third adjacent sample, and adding the fourth correction value to the fourth adjacent sample, and the odd-numbered harmonic adder performs an odd-numbered harmonic addition process for adding the odd-numbered harmonic to the digital audio signal, the odd-numbered harmonic addition process being performed by, subtracting, from the first local minimum sample, a fifth correction value obtained by multiplying a fifth difference value between the first local minimum sample and a fifth adjacent sample that is one sample before the first local minimum sample by a first coefficient for odd-numbered harmonics selected by the coefficient selector according to a third sample interval between the first local minimum sample and a second local maximum sample immediately before the first local minimum sample, adding, to the first local maximum sample, a sixth correction value obtained by multiplying the second difference value by a second coefficient for odd-numbered harmonics selected by the coefficient selector according to the first sample interval, and subtracting, from the second local minimum sample, a seventh correction value obtained by multiplying the fourth difference value by a third coefficient for odd-numbered harmonics selected by the coefficient selector according to the second sample interval, wherein the even-numbered harmonic adder:

when performing the first even-numbered harmonic addition process under a condition that the first sample interval is three and the first adjacent sample and the second adjacent sample are adjacent to each other, limits the first correction value and the second correction value such that a magnitude relationship of sample values between a first correction sample obtained by adding the first correction value to the first adjacent sample and a second correction sample obtained by subtracting the second correction value from the second adjacent sample is not reversed, and when performing the second even-numbered harmonic addition process under a condition that the second sample interval is three, and the third adjacent sample and the fourth adjacent sample are adjacent to each other, limits the third correction value and the fourth correction value such that a magnitude relationship of sample values between a third correction sample obtained by subtracting the third correction value from the third adjacent sample and a fourth correction sample obtained by adding the fourth correction value to the fourth adjacent sample is not reversed.

2. The digital audio processing device according to claim 1, wherein the even-numbered harmonic adder:

when performing the first even-numbered harmonic addition process under a condition that the first sample interval is four or more, limits the first correction value such that a sample value of the first correction sample obtained by adding the first correction value to the first adjacent sample is not larger than a sample value of a next sample that follows the first adjacent sample, and limits the second correction value such that a sample value of the second correction sample obtained by subtracting the second correction value from the second adjacent sample is not smaller than a sample value of a sample that is one sample before the second adjacent sample, and when performing the second even-numbered harmonic addition process under a condition that the second sample interval is four or more, limits the third correction value such that a sample value of the third correction sample obtained by subtracting the third correction value from the third adjacent sample is not smaller than a sample value of a next sample that follows the third adjacent sample, and limits the fourth correction value such that a sample value of the fourth correction sample obtained by adding the fourth correction value to the fourth adjacent sample is not larger than a sample value of a sample that is one sample before the fourth adjacent sample.

3. A digital audio processing method comprising:

calculating a local maximum in a sample constituting a digital audio signal that is input and detecting a local maximum sample including the local maximum;

calculating a local minimum in the sample constituting the digital audio signal and detecting a local minimum sample including the local minimum;

determining whether the sample constituting the digital audio signal is a waveform part in which a sample value increases from the local minimum sample to the local maximum sample, or a waveform part in which the sample value decreases from the local maximum sample to the local minimum sample;

counting a sample interval between the local minimum sample and the local maximum sample that are adjacent to each other in a time direction;

if the sample constituting the digital audio signal increases from a first local minimum sample to a first local maximum sample and decreases from the first local maximum sample to a second local minimum sample, performing either one of a first even-numbered harmonic addition process for adding an even-numbered harmonic to the digital audio signal, and a second even-numbered harmonic addition process for adding the even-numbered harmonic to the digital audio signal, the first even-numbered harmonic addition process being performed by adding, to a first adjacent sample that is a next sample that follows the first local minimum sample, a first correction value obtained by multiplying a first difference value between the first local minimum sample and the first adjacent sample by a first coefficient for even-numbered harmonics that is selected according to a first sample interval between the first local minimum sample and the first local maximum sample, subtracting, from a second adjacent sample that is one sample before the first local maximum sample, a second correction value obtained by multiplying a second difference value between the second adjacent sample and the first local maximum sample by the first coefficient for even-numbered harmonics, adding, to a third adjacent sample that is a next sample that follows the first local maximum sample, a third correction value obtained by multiplying a third difference value between the first local maximum sample and the third adjacent sample by a second coefficient for even-numbered harmonics that is selected according to a second sample interval between the first local maximum sample and the second local minimum sample, and subtracting, from a fourth adjacent sample that is one sample before the second local minimum sample, a fourth correction value obtained by multiplying a fourth difference value between the fourth adjacent sample and the second local minimum sample by the second coefficient for even-numbered harmonics, and the second even-numbered harmonic addition process being performed by subtracting the first correction value from the first adjacent sample, adding the second correction value to the second adjacent sample, subtracting the third correction value from the third adjacent sample, and adding the fourth correction value to the fourth adjacent sample; and performing an odd-numbered harmonic addition process for adding an odd-numbered harmonic to the digital audio signal, the odd-numbered harmonic addition process being performed by, subtracting, from the first local minimum sample, a fifth correction value obtained by multiplying a fifth difference value between the first local minimum sample and a fifth adjacent sample that is one sample before the first local minimum sample by a first coefficient for odd-numbered harmonics that is selected according to a third sample interval between the first local minimum sample and a second local maximum sample immediately before the first local minimum sample, adding, to the first local maximum sample, a sixth correction value obtained by multiplying the second difference value by a second coefficient for odd-numbered harmonics that is selected according to the first sample interval, and subtracting, from the second local minimum sample, a seventh correction value obtained by multiplying the fourth difference value by a third coefficient for odd-numbered harmonics that is selected according to the second sample interval, wherein under a condition that the first sample interval is three and the first adjacent sample and the second adjacent sample are adjacent to each other, the first even-numbered harmonic addition process is performed by limiting the first correction value and the second correction value such that a magnitude relationship of sample values between a first correction sample obtained by adding the first correction value to the first adjacent sample and a second correction sample obtained by subtracting the second correction value from the second adjacent sample is not reversed, and under a condition that the second sample interval is three, and the third adjacent sample and the fourth adjacent sample are adjacent to each other, the second even-numbered harmonic addition process is performed by limiting the third correction value and the fourth correction value such that a magnitude relationship of sample values between a third correction sample obtained by subtracting the third correction value from the third adjacent sample and a fourth correction sample obtained by adding the fourth correction value to the fourth adjacent sample is not reversed.

4. A digital audio processing program stored in a non-transitory storage medium causing a computer to execute the steps of:

calculating a local maximum in a sample constituting a digital audio signal that is input and detecting a local maximum sample including the local maximum;

calculating a local minimum in the sample constituting the digital audio signal and detecting a local minimum sample including the local minimum;

determining whether the sample constituting the digital audio signal is a waveform part in which a sample value increases from the local minimum sample to the local maximum sample, or a waveform part in which the sample value decreases from the local maximum sample to the local minimum sample;

counting a sample interval between the local minimum sample and the local maximum sample that are adjacent to each other in a time direction;

if the sample constituting the digital audio signal increases from a first local minimum sample to a first local maximum sample and decreases from the first local maximum sample to a second local minimum sample, performing either one of a first even-numbered harmonic addition step for adding an even-numbered harmonic to the digital audio signal, and a second even-numbered harmonic addition step for adding the even-numbered harmonic to the digital audio signal, the first even-numbered harmonic addition step including adding, to a first adjacent sample that is a next sample that follows the first local minimum sample, a first correction value obtained by multiplying a first difference value between the first local minimum sample and the first adjacent sample by a first coefficient for even-numbered harmonics that is selected according to a first sample interval between the first local minimum sample and the first local maximum sample, subtracting, from a second adjacent sample that is one sample before the first local maximum sample, a second correction value obtained by multiplying a second difference value between the second adjacent sample and the first local maximum sample by the first coefficient for even-numbered harmonics, adding, to a third adjacent sample that is a next sample that follows the first local maximum sample, a third correction value obtained by multiplying a third difference value between the first local maximum sample and the third adjacent sample by a second coefficient for even-numbered harmonics that is selected according to a second sample interval between the first local maximum sample and the second local minimum sample, and subtracting, from a fourth adjacent sample that is one sample before the second local minimum sample, a fourth correction value obtained by multiplying a fourth difference value between the fourth adjacent sample and the second local minimum sample by the second coefficient for even-numbered harmonics, and the second even-numbered harmonic addition step including:

subtracting the first correction value from the first adjacent sample, adding the second correction value to the second adjacent sample, subtracting the third correction value from the third adjacent sample, and adding the fourth correction value to the fourth adjacent sample; and performing an odd-numbered harmonic addition step for adding the odd-numbered harmonic to the digital audio signal, the odd-numbered harmonic addition step including:

subtracting, from the first local minimum sample, a fifth correction value obtained by multiplying a fifth difference value between the first local minimum sample and a fifth adjacent sample that is one sample before the first local minimum sample by a first coefficient for odd-numbered harmonics that is selected according to a third sample interval between the first local minimum sample and a second local maximum sample immediately before the first local minimum sample, adding, to the first local maximum sample, a sixth correction value obtained by multiplying the second difference value by a second coefficient for odd-numbered harmonics that is selected according to the first sample interval, and subtracting, from the second local minimum sample, a seventh correction value obtained by multiplying the fourth difference value by a third coefficient for odd-numbered harmonics that is selected according to the second sample interval, wherein under a condition that the first sample interval is three and the first adjacent sample and the second adjacent sample are adjacent to each other, the first even-numbered harmonic addition step includes limiting the first correction value and the second correction value such that a magnitude relationship of sample values between a first correction sample obtained by adding the first correction value to the first adjacent sample and a second correction sample obtained by subtracting the second correction value from the second adjacent sample is not reversed, and under a condition that the second sample interval is three, and the third adjacent sample and the fourth adjacent sample are adjacent to each other, the second even-numbered harmonic addition step includes limiting the third correction value and the fourth correction value such that a magnitude relationship of sample values between a third correction sample obtained by subtracting the third correction value from the third adjacent sample and a fourth correction sample obtained by adding the fourth correction value to the fourth adjacent sample is not reversed.

5. The digital audio processing method according to claim 3, wherein under a condition that the first sample interval is four or more, the first even-numbered harmonic addition process is performed by limiting the first correction value such that a sample value of the first correction sample obtained by adding the first correction value to the first adjacent sample is not larger than a sample value of a next sample that follows the first adjacent sample, and limiting the second correction value such that a sample value of the second correction sample obtained by subtracting the second correction value from the second adjacent sample is not smaller than a sample value of a sample that is one sample before the second adjacent sample, and under a condition that the second sample interval is four or more, the second even-numbered harmonic addition process is performed by limiting the third correction value such that a sample value of the third correction sample obtained by subtracting the third correction value from the third adjacent sample is not smaller than a sample value of a next sample that follows the third adjacent sample, and limiting the fourth correction value such that a sample value of the fourth correction sample obtained by adding the fourth correction value to the fourth adjacent sample is not larger than a sample value of a sample that is one sample before the fourth adjacent sample.

6. The digital audio processing program according to claim 4, wherein under a condition that the first sample interval is four or more, the first even-numbered harmonic addition step includes limiting the first correction value such that a sample value of the first correction sample obtained by adding the first correction value to the first adjacent sample is not larger than a sample value of a next sample that follows the first adjacent sample, and limiting the second correction value such that a sample value of the second correction sample obtained by subtracting the second correction value from the second adjacent sample is not smaller than a sample value of a sample that is one sample before the second adjacent sample, and under a condition that the second sample interval is four or more, the second even-numbered harmonic addition step includes limiting the third correction value such that a sample value of the third correction sample obtained by subtracting the third correction value from the third adjacent sample is not smaller than a sample value of a next sample that follows the third adjacent sample, and limiting the fourth correction value such that a sample value of the fourth correction sample obtained by adding the fourth correction value to the fourth adjacent sample is not larger than a sample value of a sample that is one sample before the fourth adjacent sample.

* * * * *